US010611008B2

(12) United States Patent
Pugliese et al.

(10) Patent No.: US 10,611,008 B2
(45) Date of Patent: Apr. 7, 2020

(54) INSTALLATION TOOLS FOR A WATER CONTAINING STRUCTURE, COMPONENTS SUITABLE FOR USE THEREWITH, AND SYSTEMS AND METHODS OF USE THEREFOR

(71) Applicant: Custom Molded Products, LLC, Newnan, GA (US)

(72) Inventors: Angelo V. Pugliese, Newnan, GA (US); Victor L. Walker, Temecula, CA (US)

(73) Assignee: Custom Molded Products, LLC, Newnan, GA (US)

( * ) Notice: Subject to any disclaimer, the term of this patent is extended or adjusted under 35 U.S.C. 154(b) by 115 days.

(21) Appl. No.: 15/817,954

(22) Filed: Nov. 20, 2017

(65) Prior Publication Data

US 2018/0141197 A1 May 24, 2018

Related U.S. Application Data

(60) Provisional application No. 62/424,491, filed on Nov. 20, 2016.

(51) Int. Cl.

| | |
|---|---|
| ***B25B 27/28*** | (2006.01) |
| ***E04H 4/14*** | (2006.01) |
| ***B25D 1/16*** | (2006.01) |
| *A47K 3/02* | (2006.01) |

(52) U.S. Cl.

CPC ..... *B25B 27/28* (2013.01); *B25D 1/16* (2013.01); *E04H 4/14* (2013.01); *A47K 3/02* (2013.01); *B25D 2250/171* (2013.01)

(58) Field of Classification Search

CPC .. B25B 27/28; E04H 4/14; B25D 1/16; B25D 2250/171; A47K 3/02

See application file for complete search history.

(56) References Cited

U.S. PATENT DOCUMENTS 5,539,979 A * 7/1996 Powers ..... B23P 6/00 29/280
6,880,217 B2 * 4/2005 Garst ..... B25B 27/0028 29/235

FOREIGN PATENT DOCUMENTS

WO WO99/23993 * 5/1999

* cited by examiner

*Primary Examiner* — John C Hong
(74) *Attorney, Agent, or Firm* — Laurence P. Colton; Smith Tempel Blaha LLC

(57) ABSTRACT

An installation tool for installing features and/or components involving a grommet onto a water containing structure assembly, and a method of use thereof, which facilitates controlled and precise application of an insertion force. The tool actively prevents or reduces the unintentional application of the insertion force onto anything surrounding the grommet. The tool, and a method of use thereof, may have an insertion force generating sub-system configured to mechanically drive a grommet-based component into the grommet, and an engagement sub-system configured to translate and impart the insertion force from the insertion force generating sub-system to the grommet-based component and the grommet. The tool may have a sturdy, stable, and slide-hammer configuration or a basic tamp configuration for use with a mallet. The slide-hammer may comprise an anvil sub-system and a hammer sub-system in a reciprocating configuration. A complimentary puller tool may be included.

19 Claims, 21 Drawing Sheets

INSTALLATION TOOLS FOR A WATER CONTAINING STRUCTURE, COMPONENTS SUITABLE FOR USE THEREWITH, AND SYSTEMS AND METHODS OF USE THEREFOR

STATEMENT OF RELATED APPLICATIONS

This patent application claims priority on and the benefit of U.S. Provisional Patent Application No. 62/424,491 having a filing date of 20 Nov. 2016.

BACKGROUND OF THE INVENTION

Technical Field

The invention relates generally to the field of hand tools and devices for use in installing components on a water containing structure and components suitable for use therewith, and relates more specifically to the field of installation tools and devices for assembling a spa, hot tub, bathtub, swimming pool, hydrotherapy tub, and other water containing structures, and components for installation in such water containing structures. The invention also relates generally to the field of slide hammers, setter tools, and puller tools for installing a grommet-based component onto the sidewall of a water containing structure, and grommet-based components suitable for installation therewith.

Prior Art

Artificial water containing structures, such as conventional spas, hot tubs, whirlpool baths, swimming pools, and hydrotherapy tubs, comprise various components and features, such as jets, lights, control panels, etc. In the most common embodiments, these components and features are assembled together, usually via or on a shell wall, such that they are accessible to or can act on a user partially immersed within the confines of the shell body.

By way of a non-limiting example, typical hydrotherapy tubs with jets mounted thereon or therethrough are constructed as a molded shell to form a water containment or fluid enclosure having a footwell or floor and an upstanding sidewall. Molded within the enclosure is at least one user station that may include a seat or platform for reclining. The shell typically is constructed of fiberglass, plastic, or a similar material, or a composite of such materials, forming a tub. One or more pumps usually are placed under the shell (the dry-side) to draw water from the hydrotherapy tub and discharge it, usually with air, into the hydrotherapy tub (the wet-side) through a plurality of jets of various types. The jets usually are mounted through the shell in either or both of the floor and sidewall.

Hydrotherapy jets may comprise a grommet or grommet (referred to generally herein as a grommet) as part of the components for mounting the jet in the side wall. Such a jet comprises a grommet that creates a superior seal between the jet body housing and the side wall while addressing the issues created by a typical torque compression system. Moreover, a grommet does not rely on expensive sealants, torque wrenches for exact compression specifications, screw thread engagement means, or scores of parts that may complicate the work area, increase preparation time, and increase costs. A grommet instead may simply press-fit a jet body housing into air-tight and water-tight engagement with the tub side wall by being positioned along the periphery of an aperture defined by the molded shell.

Furthermore, a grommet is a cost effective way to install a hydrotherapy jet. First, unlike typical hydrotherapy jet systems where two people are required to install a jet, a jet may be installed using a grommet by a single person who positions the grommet at the installation hole and then inserts the jet body housing through the grommet so as to create a squeeze/friction/press fit between the jet body housing and the spa wall (the hole therethrough), with the grommet located between the jet body housing and the spa wall (the hole therethrough). Second, a grommet does not require surface grinding on the backside of the spa wall, which is loud, dangerous, dirty, time-consuming, and potentially hazardous. A grommet seals effectively with no backside grinding surface preparation. Third, a grommet involves an installation method that is simplified, which translates into rapid turnaround, potentially fewer installers, and cost savings. Drilling occurs in a single hole-cutting step and component installation only requires positioning the grommet and installing the jet body housing.

Nonetheless, despite the many advantages a jet installed using a grommet affords to the technical field, installation of a jet using a grommet remains imperfect. To install a jet using a grommet, the grommet and the jet body housing must form a radial seal. The fit must be tight in order to make it consistent and reliable. As such, pressing the jet body housing into engagement with the grommet typically involves hammering or striking the jet body housing with a rubber mallet. This, unfortunately, is unappealing to the owners and installers of these hydrotherapy spas who fear the repetitive and erratic hammer blows will damage the integrity and superficial quality of the molded shell. Moreover, the owners and installers validly complain that having to worry about the installation of a jet using a grommet runs contrary to its fundamental principles of a simple, quick, and reliable water containing structure assembly.

Accordingly, there is a need in the art for a new and different installation tool for a water containing structure assembly, and there is a need for a method for use thereof. As such, the present invention provides an improved installation tool and method of use thereof.

BRIEF SUMMARY OF THE INVENTION

The present disclosure is related to installation tools, devices, methods, and systems for installing components and features involving a grommet onto a water containing structure assembly. Such components and features include, but are not limited to, water jets, control knobs, lights, cup holders, outlets, inlets, filters, fountains, etc. Such water containing assemblies include, but are not limited to, spas, hot tubs, pools, baths, fountains, whirlpools, etc. The present disclosure also is related to components and features that are suitable for installation using such tools and devices.

A first non-limiting and exemplary embodiment of the installation tool, which will be used as a first illustrative embodiment for the purposes of this disclosure, takes the form of a slide hammer for installing a water jet onto the sidewall of a spa. The assembled slide-hammer comprises one exemplary embodiment of a jet body housing engagement component, a slide component, a support component, an insertion force generating sub-system, and an assembly sub-system.

The jet body housing engagement component defines an exemplary embodiment of a stepped tip configuration capable of engaging symmetrically along the periphery of variously sized water jet body housings. In this way, the jet body housing engagement component is structured and configured as a one-size-fits-all or one-size-fits-most component.

The slide component is an elongate, rigid, cylindrical rod structured and configured as a shaft upon which a hammer component or sub-system mechanically reciprocates or slides to strike an anvil component or sub-system. The slide component centrally traverses the individual components or sub-systems of the slide-hammer.

The insertion force generating sub-system of the slide-hammer is a multi-piece system configured to generate at least a portion of the insertion force to be translated through the assembled slide-hammer. Moreover, the insertion force generating sub-system also is configured to generate at least a portion of the insertion force via dynamic mechanical action manually powered by an end-user.

Furthermore, the insertion force generating sub-system is, at least partially, via the slide component, in a reciprocating configuration relative to the jet body housing engagement component. The insertion force generating sub-system, at least partially, mechanically cooperates, interacts, and/or engages with the jet body housing engagement component such that any insertion force generated by the dynamic mechanical action of a manual stroke ultimately translates to the jet body housing engagement component. Moreover, the insertion force generating sub-system comprises an exemplary embodiment of an anvil sub-component and a hammer sub-system in a reciprocating configuration relative one another.

An exemplary embodiment of the support component is a handle or a handle grip.

The assembly sub-system is a multi-piece attachment set configured to facilitate the detachable yet rigid engagement between all the components and subsystems of the fully assembled slide-hammer.

A second non-limiting and exemplary embodiment of the installation tool, which will be used as a second illustrative embodiment for the purposes of this disclosure, takes the form of a tamp-for-hammer assembly also for installing a jet onto the sidewall of a water containing structure. The assembled tamp-for-hammer comprises one exemplary embodiment of the jet body housing engagement component, a shortened stem, an anvil handle, and an assembly sub-system.

The shortened stem is an elongate, rigid, cylindrical rod structured and configured as a shaft through which an insertion force applied to the anvil handle may be translated there through to the jet body housing engagement component. In another exemplary embodiment, the shortened stem may be terminated by dampening and attachment regions configured as a means for mechanically attaching the jet body housing engagement component, at one end, and the anvil handle, at the opposite end. The dampening and attachment regions also being configured as a means for dampening and/or modulating the insertion force to be translated through the assembled tamp.

The anvil handle, being a handle piece or grip, is configured to receive at least a portion of the insertion force via a manually powered hammer strike, for example. The anvil handle is terminated by an exemplary embodiment of an anvil region configured as a planar impact zone. When assembled with the jet body housing engagement component, the shortened stem, and the assembly sub-system, the anvil region of the anvil handle is structured and configured to receive any impact or strike carrying an insertion force. The anvil region may be made of, or comprise, other sub-components, structures, and/or features configured to facilitate and/or modulate and/or dampen the force translation from the anvil region to the rest of the anvil handle and to the shortened stem and finally to the jet body housing engagement component.

A third non-limiting and exemplary embodiment of the installation tool, which will be used as a third illustrative embodiment for the purposes of this disclosure, takes the form of a puller tool having a hooking portion and a pulling handle. The assembled puller tool comprises a hooking portion for hooking onto tabs or ears on a housing, component, or feature to be mounted (often referred to herein for simplicity as a housing) in the sidewall of the water containing structure and a handle portion for pulling the housing along with an associated grommet into an opening in the sidewall of the water containing structure for mounting.

The hooking portion typically comprises at least one and preferably two hooks for engaging at least one tab or ear and preferably two tabs or ears on the housing. The hooks can be simple semi-circles sized and structured to fit around the tabs or ears on the housing. The hooks are attached to a stem that attaches to the handle portion, or are attached directly to the handle portion.

The handle portion typically comprises a generally cylindrical structure that a user can grip with one or two hands, preferably one hand. As such, the outer surface of the handle portion preferably has a curved and smooth surface for more comfortable use.

The hooking portion is attached to and extends from the handle portion in a generally normal direction whereby a user can grasp the handle portion and manipulate the hooking portion. In use, the user grasps the handle portion, maneuvers the hooking portion to engage the tabs or ears on the housing, and then pulls the housing through an opening in a wall or the sidewall of the water containing structure whereby the grommet surrounding a portion of the housing engages with the inner surface of the opening in the wall or sidewall of the water containing structure, thereby causing the housing to be mounted within the opening in the wall or sidewall of the water containing structure in a friction fitting manner.

A non-limiting and exemplary embodiment of a housing, component or feature, which will be used as an illustrative embodiment for the purposes of this disclosure, takes the form of a housing for mounting a water jet onto the sidewall of a water containing structure. An exemplary housing is a known or available housing, but now comprising tabs or ears for engagement by the pulling tool. More specifically, the end of the housing that extends through the opening in the wall of the water containing structure comprises the tabs or ears, which typically take the form of protrusions from the surface of the housing preferably normal to or at least obtuse to the axis of the major cylindrical portion of the housing.

The housing comprising the tabs or ears can be used with any of the disclosed embodiments of the installation tool, with or without the pulling tool, as the tabs or ears will not interfere with the operation of the installation tool.

A representative overall system for mounting a component onto a wall of a water containing structure according to the present invention comprises the component for mounting onto the wall of the water containing structure, a grommet for sealing the component into an opening through the wall of the water containing structure, and at least one of an installation tool for installing the component into the opening through the wall of the water containing structure and a puller tool for pulling the component into the opening through the wall of the water containing structure, wherein the grommet creates a substantially watertight seal between the component and the opening through the wall of the water containing structure, wherein the installation tool operates on an end of the component that faces into a wet side of the water containing structure, which is the inside of the water containing structure holding the water, and wherein the pulling tool operates on an end of the component that extends into a dry side of a water containing structure, which is the outside of the water containing structure where the pumps, piping, filters, electronics, etc. operating the spa, hot tub, whirlpool bath, swimming pool, or hydrotherapy tub, for example.

Other representative systems can comprise subsets of the above described system, such as, for example, a system using only the installation tool a system using only the pulling tool. Preferred systems all include the component for mounting onto the wall of the water containing structure and the grommet for sealing the component into an opening through the wall of the water containing structure.

These features, and other features and advantages of the present invention will become more apparent to those of ordinary skill in the relevant art when the following detailed description of the preferred embodiments is read in conjunction with the appended drawings in which like reference numerals represent like components throughout the several views.

BRIEF DESCRIPTION OF THE DRAWINGS

In the figures, like reference numerals refer to like parts throughout the various views unless otherwise indicated. For reference numerals with letter character designations such as "102A" or "102B", the letter character designations may differentiate two like parts or elements present in the same figure. Letter character designations for reference numerals may be omitted when it is intended that a reference numeral to encompass all parts having the same reference numeral in all figures.

DETAILED DESCRIPTION OF PREFERRED EMBODIMENTS

Figure 1:
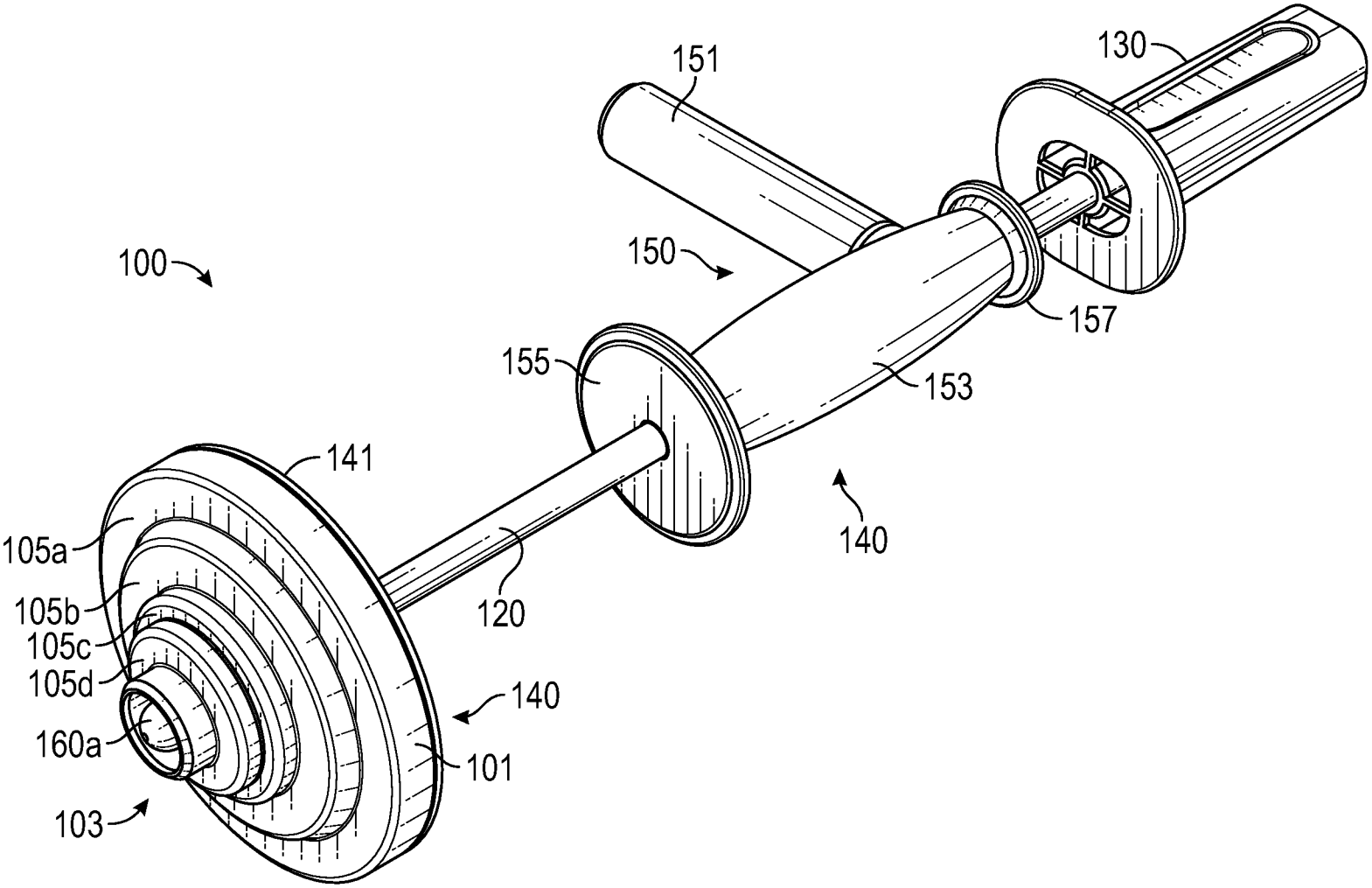
FIG. 1 is a perspective left side view of a first exemplary embodiment of an assembled installation tool of the present invention.
Figure 2:
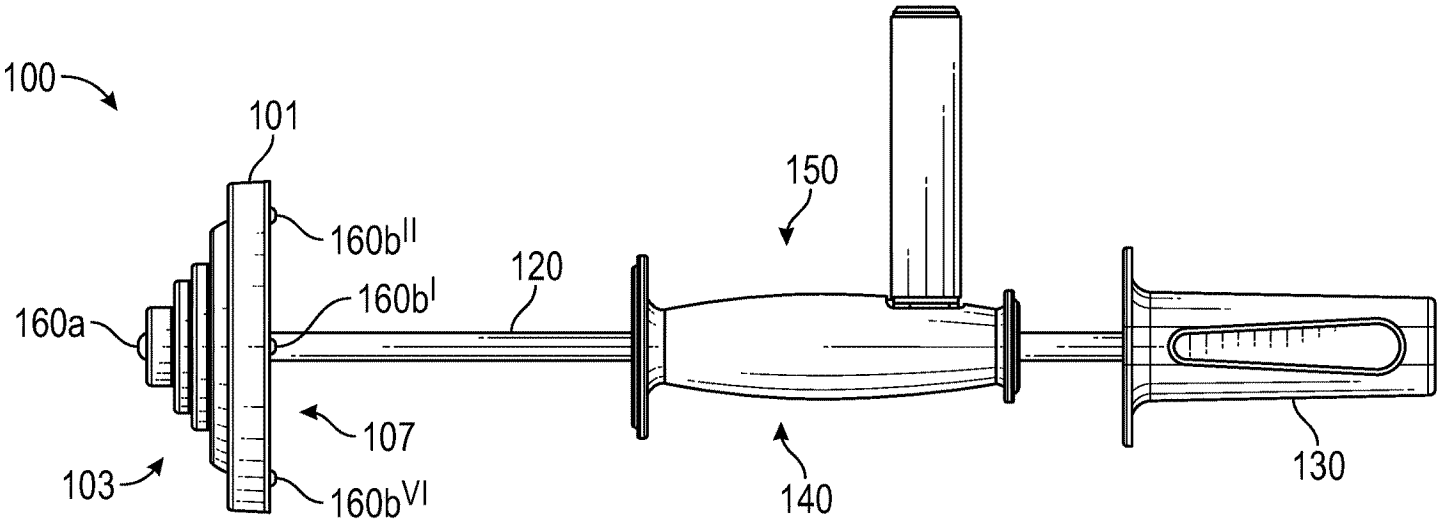
FIG. 2 is a top down view of the assembled slide-hammer of FIG. 1.
Figure 3:
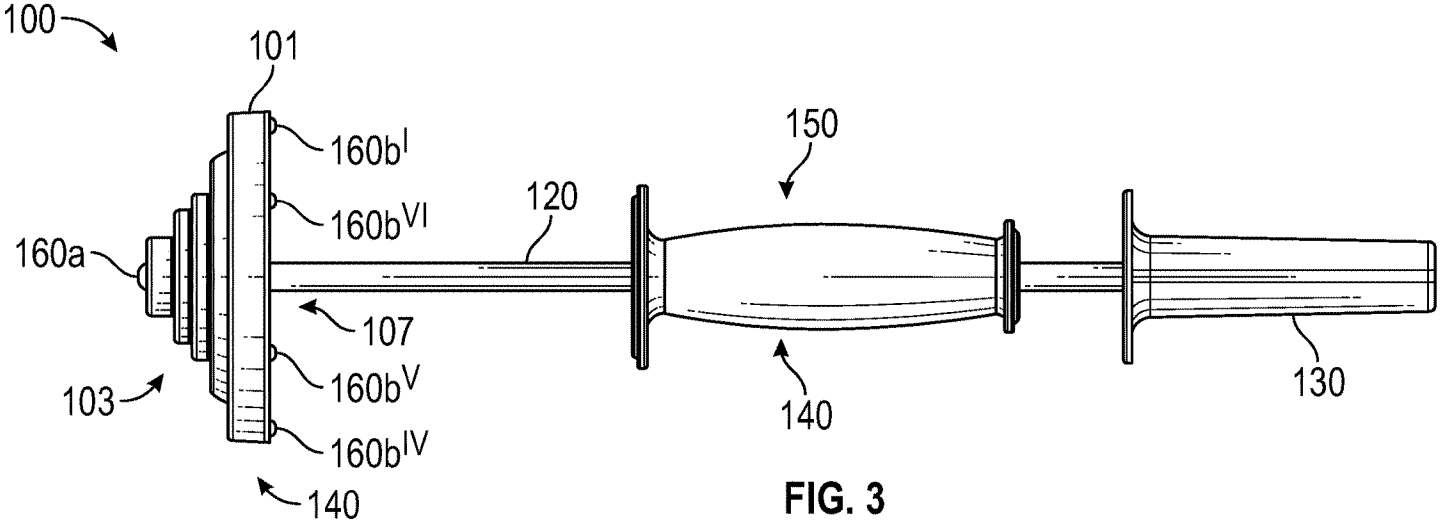
FIG. 3 is a left side view of the assembled slide-hammer of FIG. 1.
Figure 4:
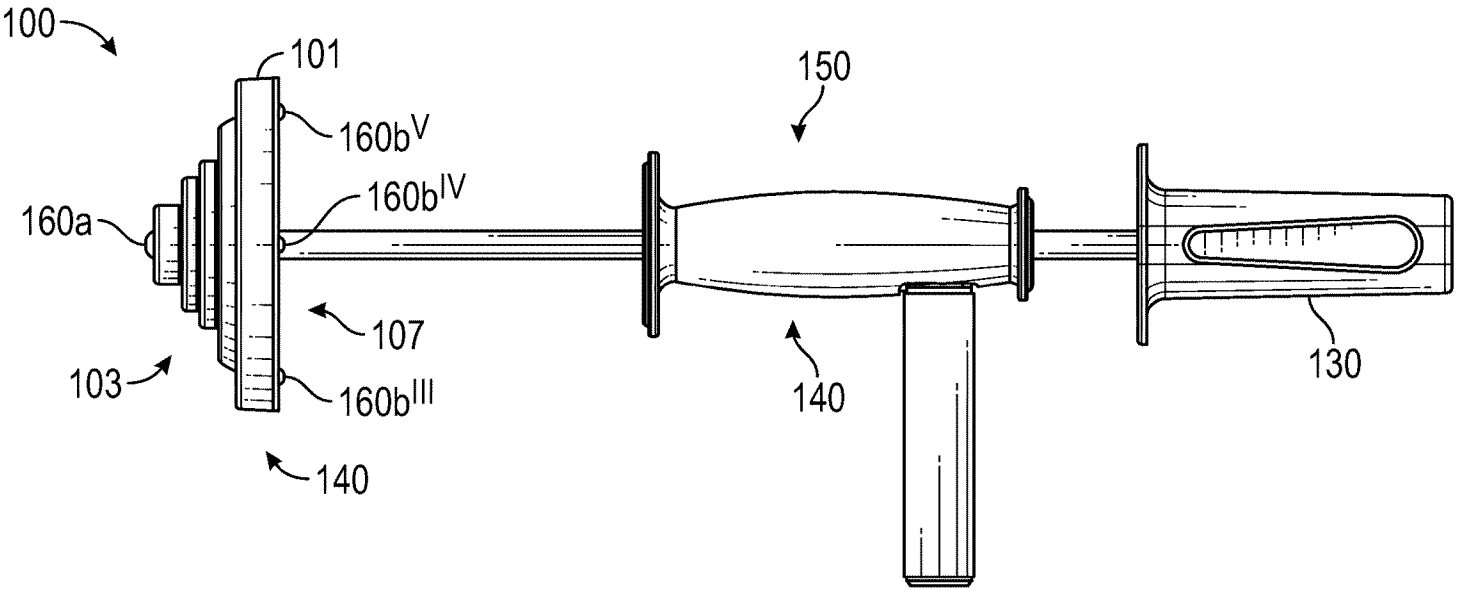
FIG. 4 is a bottom up view of the assembled slide-hammer of FIG. 1.
Figure 5:
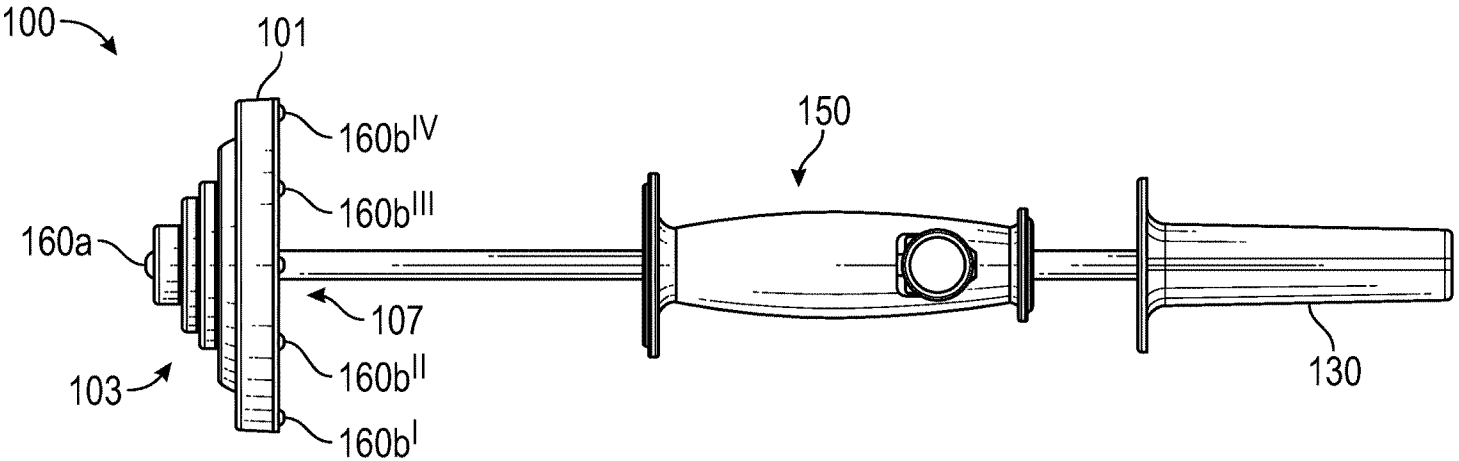
FIG. 5 is an inverted right side view of the assembled slide-hammer of FIG. 1.

The term "exemplary" is used herein to mean "serving as an example, instance, or illustration." Any aspect described herein as "exemplary" is not necessarily to be construed as preferred or advantageous over other aspects.

The present disclosure is related to installation tools for installing features or and/or components onto a water containing structure assembly involving a grommet, and systems and methods of use therefor. The installation tool may take various forms, structures, and configurations as there are various components and sub-systems for a water containing structure that may involve a grommet (e.g. jets, lights, filters, fountains, cup holders, valves, etc.). For purposes of clarity, the following detailed description is primarily related to several embodiments of installation tools for use in installing jets using grommets or grommet-like gaskets. This is not intended to limit the scope of the present disclosure; instead, this is intended to provide consistent examples with which to describe the present invention. For purposes of a thorough description, however, the following detailed description also is related to installation tools for, but not limited to, a diverter valve with a grommet, a cup-holder light with a grommet, a pop-up lighted fountain with a grommet, a spa light with a grommet, and a spa filter with a grommet, and any other features or components that can be installed onto a spa wall using a grommet.

More specifically, the installation tools, and systems and methods of use thereof, is better suited and more precise than the customary rubber mallet typically used. The installation tools, and systems and methods of use thereof, reduce or eliminate the possibility of erratic hammer blows that may partially translate an insertion force asymmetrically onto the component to be installed, such as the illustrative housing to be mounted used as an example herein, and that may partially translate the insertion force onto the surrounding portions or structures (e.g., molded shell, surrounding supplementary hydrotherapy jets, control panels/knobs/valves, lighting structures, decorative water structures) of the water containing structure.

Additionally, the installation tools, and systems and methods of use thereof, facilitate a controlled and precise application of an insertion force entirely, and only, onto the housing. In this way, the installation tools, and systems and methods of use thereof, create a tight radial seal by driving the housing, via a succession of targeted blows and/or by pulling, into the grommet. Moreover, the installation tools, and systems and methods of use thereof, actively prevent the unintentional application of the insertion force onto any other portion or structure of the water containing structure surrounding the grommet.

Furthermore, in an exemplary embodiment of the installation tool, and a method for use thereof, one important aspect is the structural design of the installation tool. The structural design is simple, elegant, and stable, resulting from affordable, simple-to-manufacture, and user-friendly components or sub-systems that form a tamp for controllably targeting and pressing the housing into the grommet.

More specifically, each individual component or sub-system may have a structural design that serves a specific function, resulting in simplified manufacturing and simplified end-user use. Each individual component or sub-system may have minimal material costs, resulting in more simplified manufacturing. Each individual component or sub-system may have optimized dimensions, density, and volume, resulting in more simplified manufacturing, and more simplified end-user use, and simplified shipping/storage. Moreover, each individual component or sub-system may allow for various ways of assembly with the other component(s) or subsystem(s), resulting in simplified and customized end-user use.

In another exemplary embodiment of the installation tool, and a method for use thereof, one important aspect of the assembled tamp is its function to drive the housing into the grommet via a succession of consistent and repeatable strikes or impacts, wherein each successive strike or impact imparts a substantially equivalent insertion force as the others, and wherein each successive strike or impact is applied to substantially the same place along the opening of the housing. In this way, the assembled tamp may facilitate simple, quick, and reliable hydrotherapy jet installation that is predictable and methodologically reproducible, every time.

More specifically, the assembled tamp may comprise an insertion force generating sub-system configured to mechanically drive the housing into the grommet. The insertion force generating sub-system may be structured and configured to create substantially the same insertion force from every successive insertion strike or impact. This is in stark contrast to a traditional rubber mallet that involves inconsistent, erratic hammering strokes with variable stroke lengths and momentum. Consequently, when installation of the housing involves the assembled tamp, the installation is more predictable in terms of the total number of insertion strikes or impacts (i.e., the total number of consistent and repeatable strikes or impacts necessary), and in terms of the total use time for successful installation.

The assembled tamp may comprise a housing engagement sub-system configured to translate and impart the insertion force from the insertion force generating sub-system to the housing. The housing engagement subsystem may be structured and configured to maintain position and alignment with the housing such that any generated insertion force is translated and imparted onto substantially the same place along the housing opening and in substantially the same direction. This is in stark contrast to a traditional rubber mallet that may involve inconsistent, erratic hammering along various points along the housing. Consequently, when installation of the housing involves the assembled tamp, the installation is less likely to result in erratic, imbalanced driving of the housing, and is less likely to result in overworking, damaging, and/or warping of the housing due to asymmetrical application of the insertion force.

In another exemplary embodiment of the installation tool, and a method for use thereof, the housing engagement sub-system may be configured to symmetrically translate and impart the insertion force from the insertion force generating sub-system to the housing. The assembled tamp may be structured and configured to engage with the housing symmetrically along the periphery of the rim of the opening of the housing, into which hydrotherapy jets are inserted into the housing, for example. Consequently, when installation of the housing involves this exemplary embodiment of the assembled tamp, the installation is more efficient and effective because the insertion force is equally applied around the housing opening, resulting in each circumferential side or end of the housing being driven equally and at the same time.

In another exemplary embodiment of the installation tool, and a method for use thereof, the housing engagement sub-system may be configured to engage with variably sized housings without structural change to the assembled tamp. The assembled tamp may be structured and configured as a one-size-fits-all or one-size-fits-most tool for most industry standard housing sizes, for example. Moreover, regardless of the particular housing type being acted upon, the housing engagement sub-system is capable of translating sufficient insertion force without substantial change to the method of use described in the present disclosure.

In another exemplary embodiment of the installation tool, and a method for use thereof, the assembled tamp may define a sturdy and stable slide-hammer configuration. An average user may operate the slide-hammer to easily and efficiently produce sufficient insertion force to drive variably sized housings into variably sized grommets. The slide-hammer may comprise a variable stroke length for generating a succession of consistent and repeatable insertion blows of variable magnitudes.

More specifically, the slide-hammer may comprise an anvil sub-system and a hammer sub-system in a reciprocating configuration. The hammer sub-system may be configured to slidably reciprocate about a set stroke relative to the anvil sub-system such that, when the hammer sub-system strikes the anvil sub-system at the end of a stroke, the hammer translates an insertion force into the anvil sub-system. The hammer sub-system may be handheld and human-powered, or mechanically automated or semi-automated, or may be facilitated by hydraulics, compressed springs, electromagnetism, etc. In this way, the slide hammer sub-system and the anvil sub-system may work in tandem as one exemplary embodiment of an insertion force generating sub-system.

In another exemplary embodiment of the installation tool, and a method for use thereof, the assembled tamp may define a sturdy and stable basic tamp configuration for use with a rubber mallet, for example. An average user would see this basic tamp configuration in stark contrast to the slide-hammer configuration because generation of any insertion-force, to drive the housing into the grommet, is derived and applied in a more traditional way. However, an average user may operate the basic tamp configuration embodiment in tandem with (one after the other, for example), or as a substitute for the slide-hammer configuration embodiment. Even though the basic tamp configuration may require the use of a separate traditional rubber mallet, the basic tamp configuration embodiment remains structured and configured to create substantially the same insertion force from every successive insertion strike or impact, and to translate and impart the insertion force by maintaining the position and alignment with the housing. As such, any generated insertion force for the basic tamp configuration may be translated and imparted onto substantially the same place along the housing opening and in substantially the same direction.

In another exemplary embodiment of the installation tool, and a method for use thereof, the installation tool takes the form of or includes a puller tool comprising a hooking portion for hooking onto tabs or ears on the housing and a handle portion for pulling the housing along with an associated grommet into an opening in the sidewall of the water containing structure for mounting. The hooking portion typically comprises at least one and preferably two hooks for engaging at least one tab or ear and preferably two tabs or ears on the housing. The hooks can be simple semi-circles sized and structured to fit around the tabs or ears on the housing. The hooks are attached to a stem that attaches to the handle portion, or are attached directly to the handle portion. The handle portion typically comprises a generally cylindrical structure that a user can grip with one or two hands, preferably one hand. As such, the outer surface of the handle portion preferably has a curved and smooth surface for more comfortable use.

The hooking portion is attached to and extends from the handle portion in a generally normal direction whereby a user can grasp the handle portion and manipulate the hooking portion. In use, the user grasps the handle portion, maneuvers the hooking portion to engage the tabs or ears on the housing, and then pulls the housing through an opening in a wall or the sidewall of the water containing structure whereby the grommet surrounding a portion of the housing engages with the inner surface of the opening in the wall or sidewall of the water containing structure, thereby causing the housing to be mounted within the opening in the wall or sidewall of the water containing structure in a friction fitting manner.

Referring now to the drawings, wherein the showings are for purposes of illustrating certain exemplary embodiments of the present disclosure only, and not for purposes of limiting the same, FIG. 1 is a perspective left side view of a first exemplary embodiment of an assembled tamp of the present disclosure. The first exemplary embodiment of the tamp of the present disclosure being in one exemplary embodiment of a slide-hammer configuration 100. The slide-hammer 100 and/or any of its components or sub-systems may be scaled to various sizes and customized in shape, color, or aesthetic appearance, based on the type of slide-hammer 100, the intended grommet, the intended grommet-based component, and/or the intended water containing structure receiving the grommet and grommet-based component. One of ordinary skill in the art understands that regardless of the specific installation circumstances, the present disclosure provides various inventive aspects and elements that are applicable to various disparate circumstances not involving a jet.

Furthermore, in the exemplary embodiment of FIG. 1, the slide-hammer 100 comprises one exemplary embodiment of a housing engagement component 101, a slide component 120, a support component 130, an insertion force generating sub-system 140, and an assembly sub-system 160. The slide-hammer 100 is separate from any housing(s) upon which it is intended to act. One of ordinary skill in the art understands that the slide-hammer 100 may comprise various other external or internal components or sub-systems that may include, but are not limited to, wiring, tubes, electric motors, batteries, etc.

In the exemplary embodiment of FIG. 1, the housing engagement component 101 is a one piece, monolithic component with embedded sub-components or regions. More specifically, the housing engagement component 101 defines, at its leading end 103, an exemplary embodiment of a stepped tip configuration capable of engaging symmetrically along the periphery of variably sized housings, for example (best seen in FIGS. 18A-18D, which show exemplary jet body housings). In this way, the stepped tip 103, with its series of concentric stepped regions 105, having decreasing diameters and increasing heights, is structured and configured as a one-size-fits-all or one-size-fits-most component for most industry standard housings. Moreover, the housing engagement component 101 may be made of, or comprise, other sub-components, structures, and/or features configured to facilitate the function of the stepped tip 103.

In the exemplary embodiment of FIG. 1, when assembled with the slide component 120, the insertion force generating sub-system 140, and the assembly sub-system acorn crown nut 160*a*, the housing engagement component 101 terminates one end of the slide-hammer 100 with the stepped tip 103 leading. Moreover, the housing engagement component 101 is supported by the slide component 120 and at least a portion of the assembly sub-system 160; however, other sub-components, structures, and/or features of the slide-hammer 100 may also provide structural support. Tip 103 may be molded directly onto the slide component 120.

The housing engagement component 101 is a molded, forged, or assembled component that can have a hollow interior 109 to save on material cost and/or weight. The hollow interior 109 is complementary of the stepped tip 103 structure, with its series of concentric stepped regions 105, and the traversing radial spars 111 (best seen in FIG. 9). The housing engagement component 101 is generally defined by an exemplary embodiment of a complex cross-section 113 (best seen in FIG. 9). The housing engagement component 101 may, however, be generally defined by various differently shaped cross-sections (e.g., square, rectangular, triangular, circular, depending on the specific region or feature).

The housing engagement component 101 may be manufactured from affordable, yet resilient, metals, composites, and/or synthetic materials. In such an embodiment, the housing engagement component 101 demands minimal material costs but provides sufficient mass, so as to generate sufficient insertion force during use without failing (breaking, deforming, bending, buckling, cracking, and/or flaking) due to its engagement with the housing 10. It is envisioned that the housing engagement component 101 is an easy-to-manipulate component piece that is easily assembled and installed by an end user. Moreover, a person having ordinary skill in the art recognizes that the housing engagement component 101 may be made of any material(s) and/or lined by any material(s); however, generally, the component is comprised of, or superficially lined by, rubber, plastic, and or a corrosion resistant material(s). This is especially true for any region of the housing engagement component 101 intended to interact with or contact a jet.

The slide component 120 of the slide-hammer 100 also is a one piece, monolithic component with embedded sub-components or regions. More specifically, the slide component 120 is an elongate, rigid, cylindrical rod terminated by an exemplary embodiment of threading 121 at opposite ends (best seen in FIG. 8). In this way, the slide component 120, with its smooth cylindrical surface, is also structured and configured as the shaft upon which a hammer component or sub-system mechanically reciprocates or strokes to strike an anvil component or sub-system (best seen in FIG. 16). The slide component 120 may be made of, or comprise, other sub-components, structures, and/or features configured to facilitate the slidable, mechanical interaction between it and the hammer component/subcomponent (e.g., a splined external surface for a complementary splined hammer component/sub-system, a grooved external surface for a complementary splined hammer component/sub-system, a frictionless or friction reducing external surface or surface coating for a complementary hammer component/sub-system).

Figure 8:
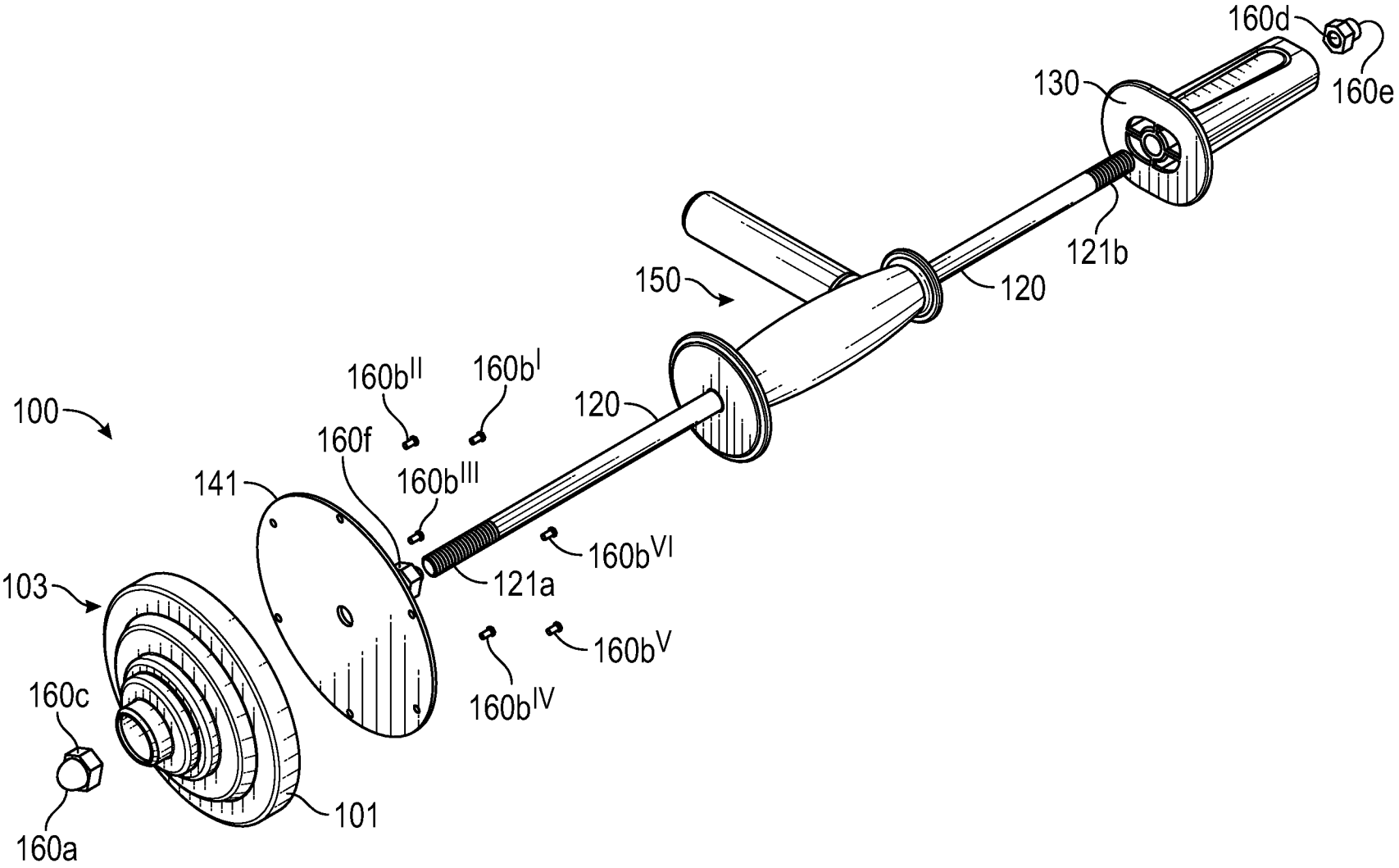
FIG. 8 is a perspective left side exploded view of the assembled slide-hammer of FIG. 1.

When assembled with the housing engagement component 101, the support component 130, and the insertion force generating sub-system 140, the slide component 120 structurally supports, based at least in part on its threaded ends 121 and the separate assembly sub-system 160, the various components, sub-systems, structures, and/or features of the slide-hammer 100 (best seen in FIG. 8). More specifically, the slide component 120 centrally traverses the individual components or sub-systems and is, therefore, positioned parallel to the central longitudinal axis of the assembled slide-hammer 100. The slide component 120 may be made of, or comprise, other sub-components, structures, and/or features configured to facilitate the support function or to facilitate the assembly sub-system 160. A person of ordinary skill in the art understands, however, that another component or sub-system other than the slide component 120 may provide the primary source of structural support for the slide-hammer 100.

The slide component 120 may be hollow or imbued or embedded with other sub-components, structures, and/or features that may include, but are not limited to, wiring, tubes, electric motors, batteries, etc. The slide component 120 is generally defined by an exemplary embodiment of a rounded cross-section that facilitates the slidable, reciprocating stroke between any hammer component or sub-system and any anvil component or sub-system. The slide component 120 may, however, be generally defined by various differently shaped cross-sections (e.g., square, rectangular, triangular, complexly shaped), depending on the specific embodiment.

The slide component 120 may be manufactured from affordable, yet resilient, metals, composites and/or synthetic materials. In such an embodiment, the slide component 120 demands minimal material costs but provides sufficient strength and rigidity, so as to support any attached component or sub-system and so as to facilitate their mechanical interaction (e.g., sliding, stroking, or reciprocating). Nonetheless, despite the structural support optionally provided by the slide component 120, the slide component 120 is an easy-to-manipulate component piece that is easily assembled and installed by an end user. A person having ordinary skill in the art recognizes that the slide component 120 may be made of any material(s) and/or lined by any material(s); however, generally, the component is comprised of, or superficially lined by, friction reducing or friction-less material(s).

The insertion force generating sub-system 140 of the slide-hammer 100 is a multi-piece system configured to generate at least a portion of the insertion force to be translated through the assembled slide-hammer 100. Moreover, the insertion force generating sub-system 140 is also configured to generate at least a portion of the insertion force via dynamic mechanical action manually powered by an end-user.

More specifically, the insertion force generating sub-system 140 is supported by the slide component 120 and at least a portion of the assembly sub-system 160. The insertion force generating sub-system 140 is, at least partially, via the slide component 120, in a reciprocating configuration relative to the housing engagement component 101 (also supported by the slide component 120). Moreover, when assembled with the housing engagement component 101, the slide component 120, and the support component 130, the insertion force generating sub-system 140, at least partially, slides along the traversing length of the slide component 120 between the housing engagement component 101 and the support component 130.

Furthermore, in the exemplary embodiment of FIG. 1, the insertion force generating sub-system 140, at least partially, mechanically cooperates, interacts, or engages with the housing engagement component 101 such that any insertion force generated by the dynamic mechanical action of a manual stroke ultimately translates to the housing engagement component 101. More specifically, when assembled with the housing engagement component 101, the slide component 120, the support component 130, and the assembly sub-system 160, the insertion force generating sub-system 140, at least partially, engages directly up against to the static housing engagement component 101. Moreover, the mechanically dynamic portion of the insertion force generating sub-system 140 is mechanically linked to its distinct static portion. In this way, the dynamic portion of the insertion force generating sub-system 140 translates any generated insertion force to the static portion and, thereby, translates any generated insertion force to the housing engagement component 101 for tamping.

In the exemplary embodiment of FIG. 1, two individual pieces make up the insertion force generating sub-system 140, although not all embodiments require these two individual pieces. More specifically, the insertion force generating sub-system 140 comprises an exemplary embodiment of an anvil sub-component 141 and a hammer sub-system 150 in a reciprocating configuration relative one another. One of ordinary skill in the art understands that the insertion force generating sub-system 140 may comprise various other external or internal sub-components or sub-systems. Moreover, the anvil component 141, the hammer sub-system 150, and/or any of its sub-components or sub-systems may be scaled to various sizes and customized in shape, color, or aesthetic appearance, based on the type, the intended use, and/or the physical requirements.

The anvil sub-component 141 is a one piece, monolithic disk component. More specifically, the anvil sub-component 141 is an exemplary embodiment of a planar impact plate defining an exemplary embodiment of a disk-shape and a thin profile (relative to the other slide-hammer 100 components or sub-systems like the housing engagement component 101, for example) (best seen in FIG. 8). When assembled with the housing engagement component 101, the slide component 120, and the assembly sub-system 160, the anvil sub-component 141 engages directly and flush, up along its planar side, to a trailing end 107 of the housing engagement component 101 such that the hollow interior 109 is defined between the stepped tip 103 and at least a portion of the anvil sub-component 141 (best seen in FIG. 9 relative to FIG. 1).

In this way, the anvil sub-component 141, which is rigidly, yet detachably, mechanically engaged to the housing engagement component 101, is structured and configured as the static portion of the insertion force generating sub-system 140. As such, the anvil sub-component 141 is also structured and configured to receive, via the dynamic mechanical portion of the insertion force generating sub-system 140, any manual-stroke-generated impacts or strikes carrying the insertion force (best seen in FIG. 16). Moreover, the anvil sub-component 141 may be made of, or comprise, other sub-components, structures, and/or features configured to facilitate the force translation from the anvil sub-component 141 to the stepped tip 103, or to facilitate the mechanical engagement therebetween.

The anvil sub-component 141 can be a molded, forged, or assembled component. The anvil sub-component 141 may be solid or imbued or embedded with other sub-components, structures, and/or features that may include, but are not limited to, dampeners, sound insolation, wiring, tubes, electric motors, batteries, etc. Moreover, the anvil sub-component 141 is generally defined by a planar shape that complements the planar surface defined by the trailing end 107 of the housing engagement component 101, and that facilitates receiving impacts from the mechanically dynamic portion of the insertion force generating sub-system 140 (best seen in FIGS. 9-11). The slide component 120 may, however, be generally defined by any shape (e.g., undulated, wavy, curved) so long as its mechanical engagement with the housing engagement component 101 or with the mechanically dynamic portion allows for efficient and effective translation of any generated insertion force.

The anvil sub-component 141 may be manufactured from affordable, yet resilient, metals, composites and/or synthetic materials. In such an embodiment, the anvil sub-component 141 demands minimal material costs but provides sufficient strength and rigidity so as to tolerate and translate any generated insertion force without structural compromise or weakness. Nonetheless, the anvil sub-component 141 is an easy-to-manipulate component piece that is easily assembled and installed by an end user.

The hammer sub-system 150 of the insertion force generating sub-system 140 is a multi-piece, mechanically dynamic system configured to generate, via manual strokes, any insertion force to be translated through the assembled slide-hammer 100. More specifically, the hammer sub-system 150 is supported by the slide component 120 and at least a portion of the assembly sub-system 160. The hammer sub-system 150 is, at least partially, via the slide component 120, in a reciprocating configuration relative to the housing engagement component 101 and its detachably engaged anvil sub-component 141. As such, when assembled with the housing engagement component 101, the slide component 120, and the support component 130, the hammer sub-system 150 is structured and configured to slide along the traversing length of the slide component 120 between the housing engagement component 101 and the support component 130 (best seen in FIG. 16).

The hammer sub-system 150 mechanically cooperates, interacts, or engages with the anvil sub-component 141 such that any insertion force generated by the dynamic mechanical action of the hammer sub-system 150 ultimately translates to the anvil sub-component 141 and, thereby, to the housing engagement component 101. More specifically, when assembled with the housing engagement component 101, the slide component 120, the support component 130, and the assembly sub-system 160, the hammer sub-system 150 is capable of sliding, stroking, or reciprocating and striking or impacting the anvil sub-component 141.

Furthermore, in the exemplary embodiment of FIG. 1, four individual pieces make up the hammer sub-system 150 (best seen in FIG. 12), although not all embodiments require these four individual pieces. More specifically, the hammer sub-system 150 comprises an exemplary embodiment of a side handle with threaded stud 151, a hammer weld 153, an impact washer 155, and a rubber bumper 157. One of ordinary skill in the art understands that the hammer sub-system 150 may comprise various other external or internal sub-components or sub-systems. Moreover, the hammer sub-system 150 and/or any of its sub-components or sub-systems may be scaled to various sizes and customized in shape, color, or aesthetic appearance, based on the type, the intended use, and/or the physical requirements.

The support component 130 of the slide-hammer 100 is an elongate injection-molded or cast component with embedded sub-components or regions, and can be considered as a handle piece. More specifically, the support component 130 is an exemplary embodiment of a handle piece defining an exemplary embodiment of traversing aperture 131 (best seen in FIG. 14). In this way, the support component 130, with its smooth traversing aperture 131, is also structured and configured as a slot for receiving a traversing portion of the smooth straight slide component 120 (at the threaded end **121*b* as best seen in FIG. 8). The slide traversing aperture 131 may, however, be generally defined by any shape so long as its mechanical engagement with the slide component 120 allows for a user to readily and easily manipulate the assembled slide-hammer 100, at least in part, by the support component 130**.

The support component 130 may be made of, or comprise, other sub-components, structures, and/or features configured to facilitate mechanical, detachable engagement with the slide component 120 (e.g., a splined internal surface along the traversing aperture 131 for a complementary splined slide component 120; a grooved internal surface along the traversing aperture 131 for a complementary slide component 120; a frictionless or friction reducing traversing aperture 131 for a complementary splined slide component 120). Moreover, the support component 130 may include, but is not limited to, wiring, tubes, electric motors, batteries, etc.

The support component 130 may be manufactured from affordable and light, yet resilient, composite and/or synthetic materials. In such an embodiment, the support component 130 demands minimal material costs, relative weight, or relative volume. Moreover, despite its thin, elongate structure and the support provided by the slide component 120, the support component 130 may be configured to resist bending or buckling, due to its weight or the weight of the assembled sliding-hammer 100 when in use. It is envisioned that the support component 130 is a lightweight and easy-to-manipulate component piece that is easily assembled and installed by an end user.

The assembly sub-system 160 of the slide-hammer 100 is a multi-piece attachment set configured to facilitate the detachable yet rigid engagement between all the components and subsystems of the fully assembled slide-hammer 100. More specifically, the assembly sub-system 160 comprises exemplary embodiments of two acorn crown nuts, two lock washer springs, a hex nut, and six socket button head cap screws (best seen in FIG. 8), although not all embodiments require such varied combination of non-limiting attachment means. One of ordinary skill in the art understands that the assembly sub-system 160 may comprise various other sub-components or sub-systems (e.g. adhesives, screws, bolts, magnets, interlocking features). Moreover, the assembly sub-system 160 and/or any of its sub-components or sub-systems may be scaled to various sizes and customized in shape, color, or aesthetic appearance.

Referring now to FIGS. 2-5, a top down view, a left side view, a bottom up view, and an inverted right side view of the assembled slide-hammer of FIG. 1 are shown. The exemplary embodiments illustrated in FIGS. 2-5 are similar to the exemplary embodiment illustrated in FIG. 1 and, therefore, only the differences between these exemplary embodiments are described.

As previously stated, when assembled with the housing engagement component 101, the slide component 120, and the assembly sub-system 160, the anvil sub-component 141 engages directly and flush, up along its planar side, to the trailing end 107 of the housing engagement component 101. More specifically, the socket button head cap screws 160$b^{I}$-160$b^{VI}$ detachably engage the anvil sub-component 141 to the housing engagement component 101 (best seen in FIG. 8).

Figure 6:
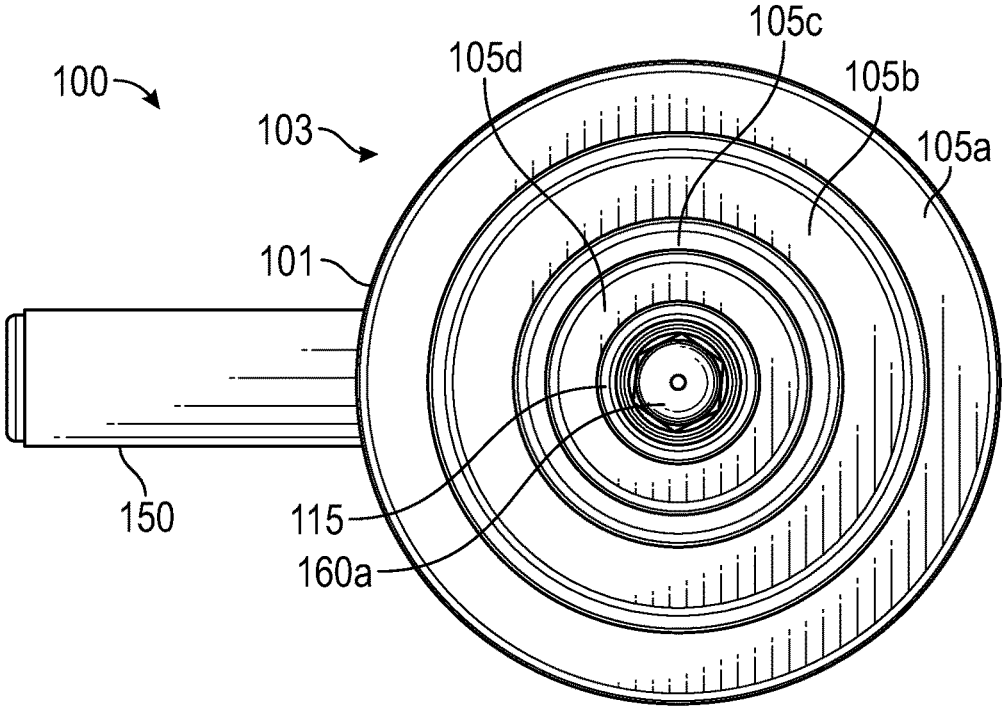
FIG. 6 is a front view of the assembled slide-hammer of FIG. 1.

Referring now to FIG. 6, a front view of the assembled slide-hammer of FIG. 1 is shown. The exemplary embodiment illustrated in FIG. 6 is similar to the exemplary embodiment illustrated in FIG. 1 and, therefore, only the differences between these exemplary embodiments are described.

As previously stated, when assembled with the slide component 120, the insertion force generating sub-system 140, and the assembly sub-system acorn crown nut 160*a*, the housing engagement component 101 terminates one end of the slide-hammer 100 with the stepped tip 103 leading. The stepped tip 103 comprises a series of concentric stepped regions 105. More specifically, the acorn crown nut 160*a* along with a lock washer spring 160*c* is positioned within an exemplary embodiment of a hollow cylindrical projection 115 extending laterally off of the stepped region 105*d*. The acorn crown nut 160*a* and the lock washer spring 160*c* engage with the threaded end 121*a* of the slide component 120 as it traverses through the housing engagement component 101 (best seen in FIG. 8). A person of ordinary skill in the art understands that the hollow cylindrical projection 115 may be structured, shaped, and configured differently depending on the specific embodiment.

Figure 7:
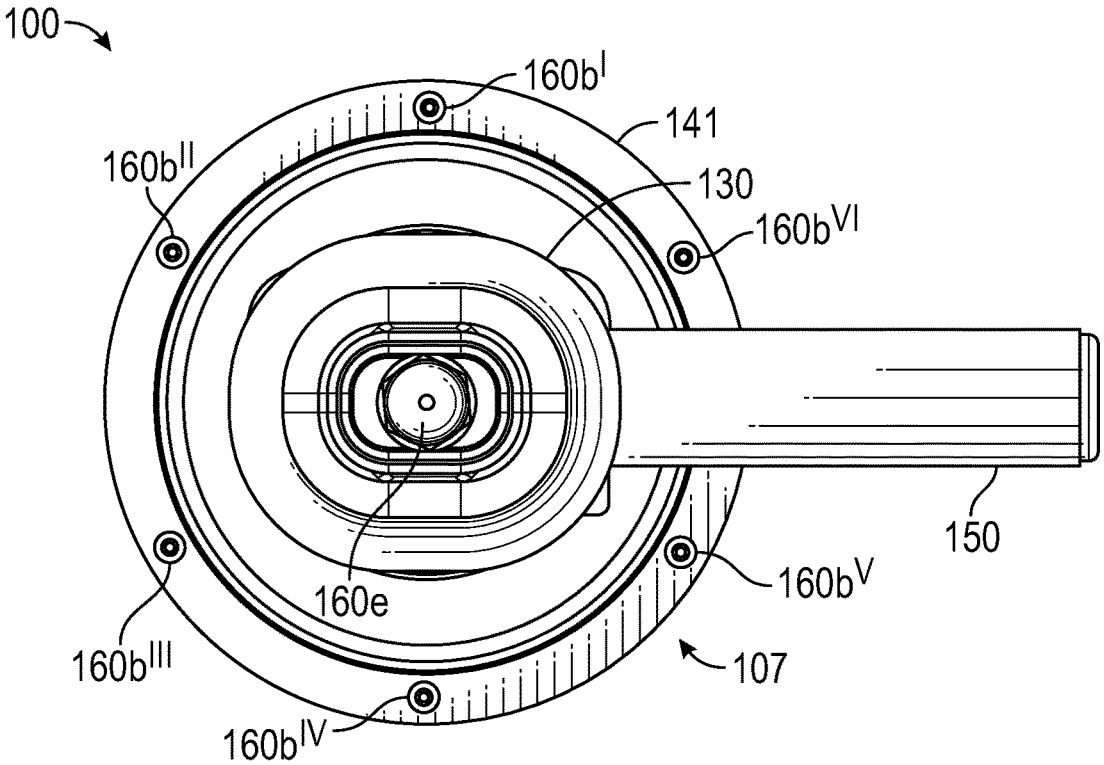
FIG. 7 is a rear view of the assembled slide-hammer of FIG. 1.

Referring now to FIG. 7, a rear view of the assembled slide-hammer of FIG. 1 is shown. The exemplary embodiment illustrated in FIG. 7 is similar to the exemplary embodiment illustrated in FIG. 1 and, therefore, only the differences between these exemplary embodiments are described.

As previously stated, when assembled with the slide component 120 and the assembly sub-system 160, the support component 130 terminates the end of the slide-hammer 100 opposite the housing engagement component 101. The support component 130 defines the traversing aperture 131, which is structured and configured as a slot for receiving the traversing portion of the slide component 120. More specifically, a second acorn crown nut 160*e* along with a second lock washer spring 160*d* engages with the threaded end 121*b* of the slide component 120 as it traverses through the traversing aperture 131 (best seen in FIG. 8).

Referring now to FIG. 8, a perspective left side exploded view of the assembled slide-hammer of FIG. 1 is shown. The exemplary embodiment illustrated in FIG. 8 is similar to the exemplary embodiment illustrated in FIG. 1 and, therefore, only the differences between these exemplary embodiments are described.

As previously stated, when assembled with the slide component 120, the insertion force generating sub-system 140, the acorn crown nut 160*a*, and the lock washer spring 160*c*, the housing engagement component 101 terminates one end of the slide-hammer 100. The acorn crown nut 160*a* and the lock washer spring 160*c* are positioned within the hollow cylindrical projection 115 extending laterally off of the stepped region 105*d*. More specifically, the detachable engagement function of the acorn crown nut 160*a* and the lock washer spring 160*c*, at the leading end 103 of the housing engagement component 101, is facilitated by the corresponding hex nut 160*f* positioned at the trailing end 107. The hex nut 160*f* engages with the threaded end 121*a* of the slide component 120 on the trailing end 103, and the engagement portion is sandwiched between the hex nut 160*f* and the acorn crown nut 160*a* and lock washer spring 160*c*. In this way, the housing engagement component 101 may be rigidly yet detachably engaged to the slide component 120 via tightening of the acorn crown nut 160*a* and/or the hex nut 160*f*.

Figure 9:
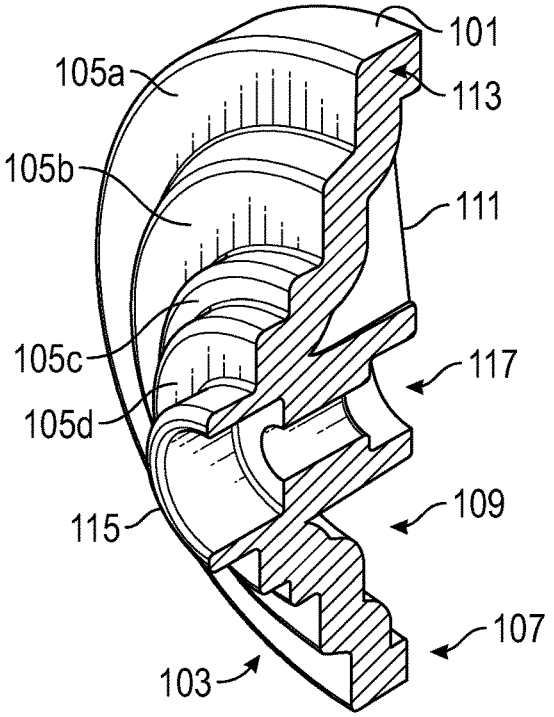
FIG. 9 is a sectional left side view of the exploded jet body housing engagement component of FIG. 8.
Figure 10:
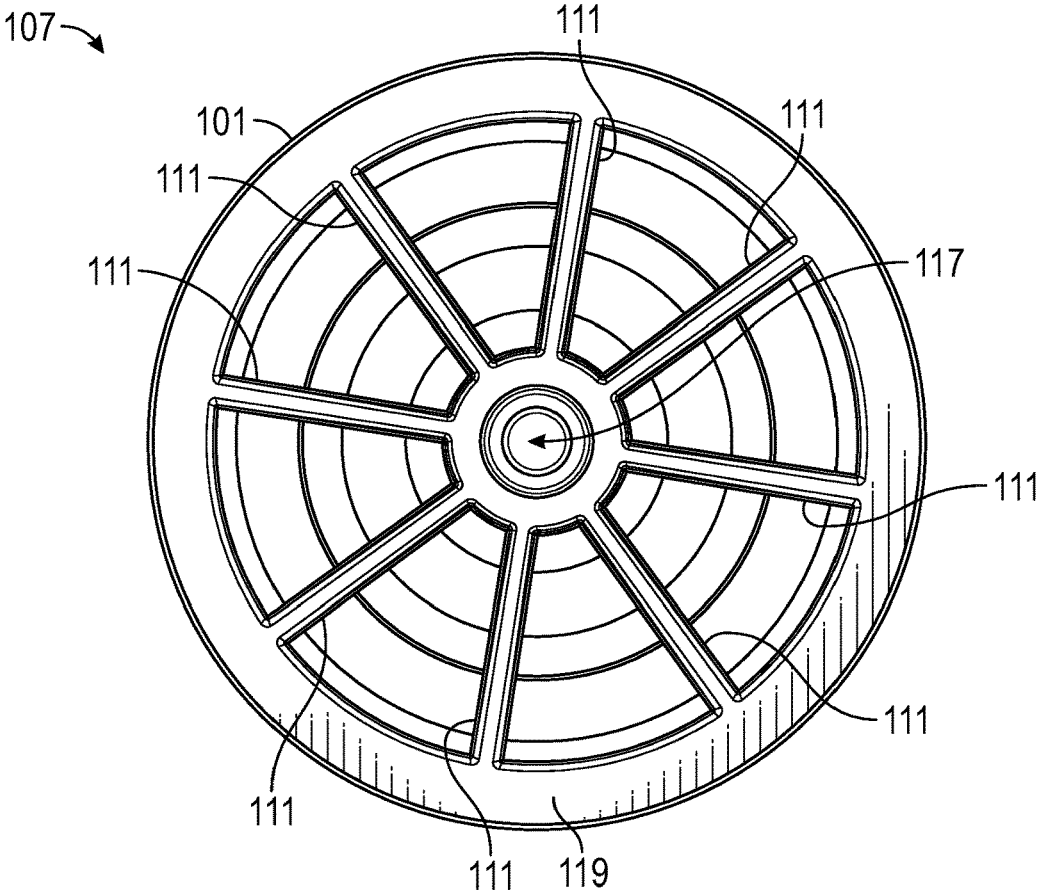
FIG. 10 is a rear view of the exploded jet body housing engagement component of FIG. 8.
Figure 11:
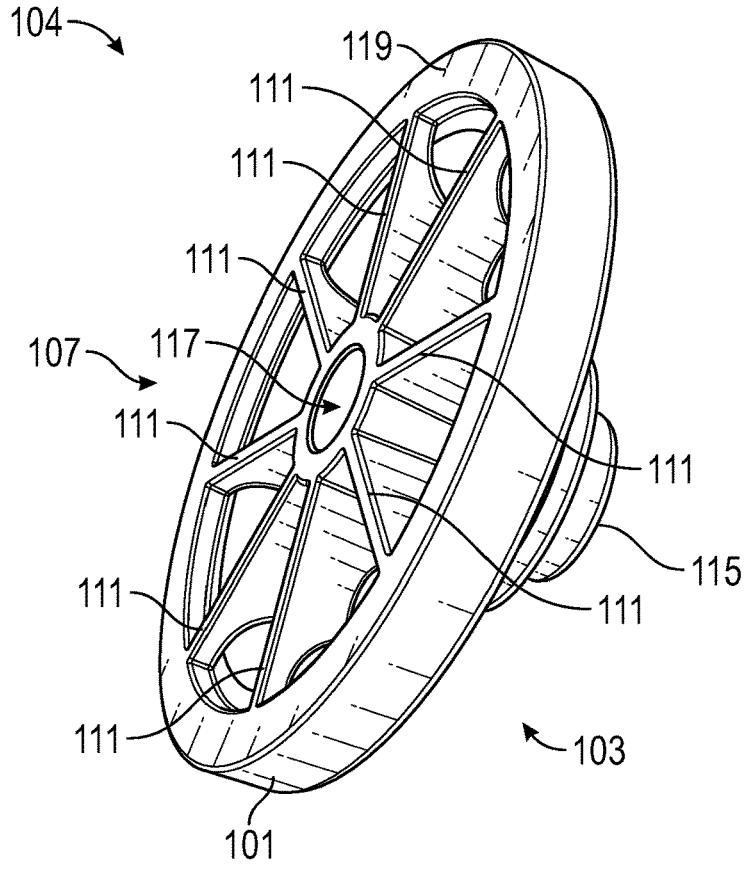
FIG. 11 is a perspective right side view of the exploded jet body housing engagement component of FIG. 8.

Referring now to FIGS. 9-11, a sectional left side view, a rear view, and a perspective right side view of the exploded housing engagement component 101 of FIG. 8 are shown. The exemplary embodiments illustrated in FIGS. 9-11 are similar to the exemplary embodiment illustrated in FIG. 8 and, therefore, only the differences between these exemplary embodiments are described.

As previously stated, when assembled with the slide component 120, the anvil sub-component 141, the acorn crown nut 160*a*, the lock washer spring 160*c*, and the hex nut 160*f*, the housing engagement component 101 is tightly and detachably engaged to one end of the slide-hammer 100 such that it does not wobble or shift in position relative to the slide component 120. The acorn crown nut 160*a* and lock washer spring 160*c* are positioned within the hollow cylindrical projection 115 extending laterally off of the stepped region 105*d*. Similarly, the hex nut 160*f* engages with the threaded end 121*a* of the slide component 120 on the trailing end 103. The housing engagement component 101 defines the hollow interior 109 and traversing radial spars 111. Moreover, the anvil sub-component 141 engages directly and flush up along a planar side of the trailing end 107 of the housing engagement component 101 such that the hollow interior 109 is defined between the stepped tip 103 and at least a portion of the anvil sub-component 141.

More specifically, the threaded end 121*a* of the slide component 120 traverses through an exemplary embodiment of a second traversing aperture 117 (best seen in FIG. 8). In this way, the smooth traversing aperture 117 is structured and configured as a slot for receiving a traversing portion of the smooth straight slide component 120 (at the threaded end 121*a* as best seen in FIG. 8). The traversing aperture 117 may, however, be generally defined by any shape or structure (e.g., a splined internal surface along the traversing aperture 117 for a complementary splined slide component 120, a grooved internal surface along the traversing aperture 117 for a complementary splined slide component 120, a frictionless or friction reducing traversing aperture 117 for a complementary slide component 120).

Furthermore, in the exemplary embodiment of FIG. 9, the traversing aperture 117 has an exemplary embodiment of a middle region with a slightly reduced circumference relative to the exemplary embodiment of the outside regions more proximate to the leading end 103 and the trailing end 107. The reduced circumference middle region fits snuggly up against the traversing portion of the slide component 120, while the larger circumference outside regions facilitate receiving the assembly sub-system 160 components. More specifically, the larger circumference outside region proximate to the hollow cylindrical projection 115 facilitates reception of the acorn crown nut 160*a* and the lock washer spring 160*c*. Similarly, the larger circumference outside region proximate to the trailing end 107 facilitates reception of the hex nut 160*f*.

In the exemplary embodiment of FIG. 10, there are eight traversing radial spars 111 within the hollow interior 109 of the housing engagement component 101. The eight traversing radial spars 111 are equally spaced about the central rotational axis of the housing engagement component 101, which is aligned and parallel to the longitudinal length of the traversing aperture 117. The eight traversing radial spars extend from the leading end 103, where they complement the shape of the stepped regions 105 (flush up against the stepped regions as best seen in FIG. 9), out towards to the trailing end 107 to the edge of the hollow interior 109, where the anvil sub-component 141 would be positioned when attached. The eight traversing radial spars are positioned like spokes on a wheel. A person of ordinary skill in the art understands that any number of traversing radial spars, with various different shapes, structures, and configurations are possible, based on the shape and structure defined by the hollow interior 109.

The trailing end 107 of the housing engagement component 101 comprises an exemplary embodiment of a planar engagement rim 119 about its perimeter. In this way, the planar engagement rim 119 is configured and structured to receive flush engagement with the anvil sub-component 141 (with its complementary disk-shape via the socket button head cap screws 160$b^{I}$-160$b^{VI}$ as best seen in FIG. 8).

Figure 12:
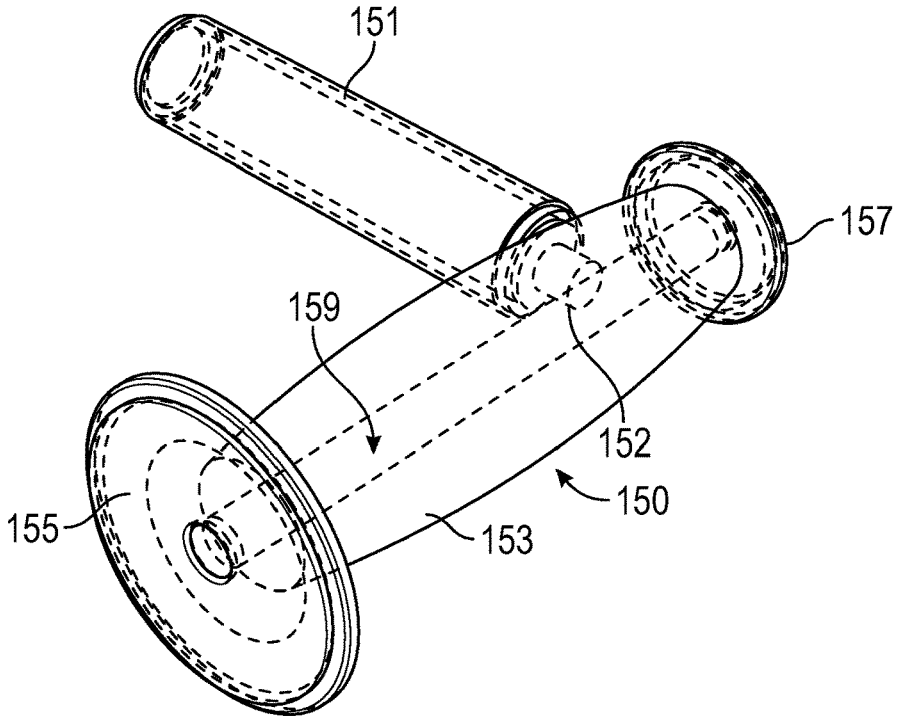
FIG. 12 is a perspective view of the exploded insertion force generating sub-system of FIG. 8.
Figure 13:
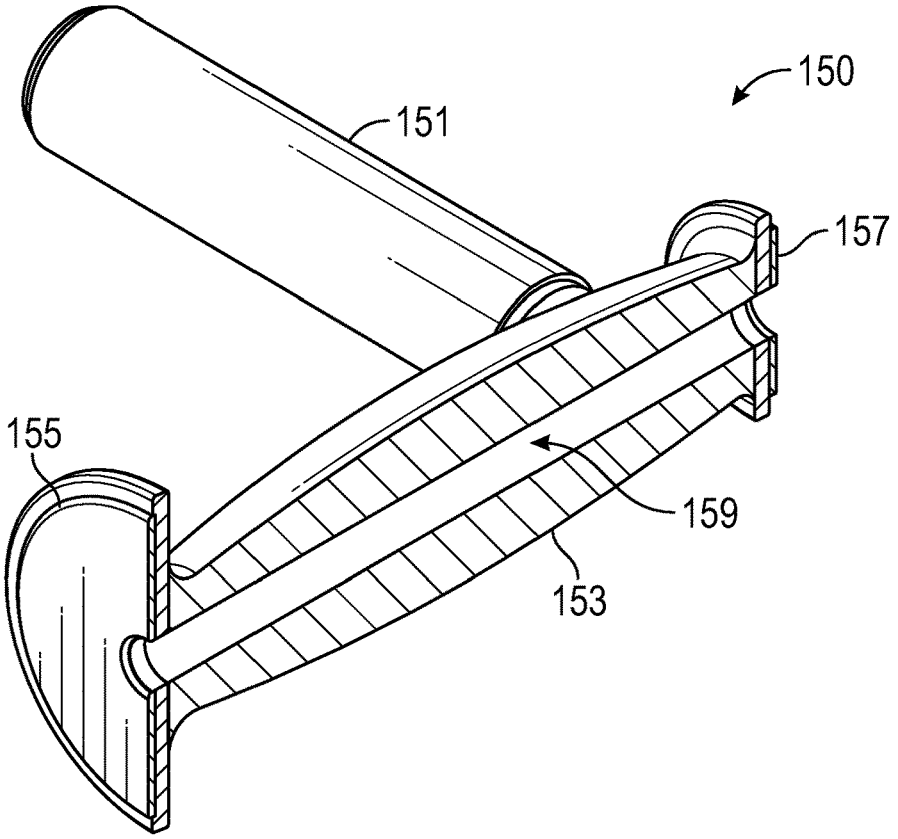
FIG. 13 is a sectional left side view of the exploded insertion force generating sub-system of FIG. 8.

Referring now to FIGS. 12 and 13, a perspective view, and a sectional left side view of the exploded insertion force generating sub-system of FIG. 8 are shown. The exemplary embodiment illustrated in FIGS. 12 and 13 are similar to the exemplary embodiment illustrated in FIG. 8 and, therefore, only the differences between these exemplary embodiments are described.

As previously stated, when assembled with the housing engagement component 101, the slide component 120, and the support component 130, the hammer sub-system 150 is structured and configured to slide along the traversing length of the slide component 120 between the housing engagement component 101 and the support component 130. The hammer sub-system 150 is capable of sliding, stroking, or reciprocating and striking or impacting the anvil sub-component 141, which is engaged to the housing engagement component 101. Moreover, the hammer sub-system 150 comprises the side handle with threaded stud 151, the hammer weld 153, the impact washer 155, and the rubber bumper 157.

More specifically, the side handle with threaded stud 151 is an elongate extrusion-molded component with embedded sub-components or regions. The side handle with threaded stud 151 is an exemplary embodiment of a cylindrical handle defining an exemplary embodiment of a threaded stud at one end (best seen in FIG. 12). In this way, the side handle 151, with its threaded stud, is configured to detachably engage with the hammer weld 153 at the threaded reception port 152 such that the side handle 151 extends laterally off of the hammer weld 153. Moreover, the side handle with threaded stud 151 is also configured to receive manipulation from an end-user, to slide or stroke the hammer sub-system 150 along the slide component 101, and to strike or impact the anvil component 141. The side handle with threaded stud 151 may be made of, or comprise, other sub-components, structures, and/or features configured to facilitate this function.

In the exemplary embodiment of FIG. 12, the hammer weld 153 is a component with embedded sub-components or regions. More specifically, the hammer weld 153 is an elongate component defining an exemplary embodiment of traversing aperture 159 extending between opposite ends of the hammer weld 153. In this way, the traversing aperture 159 of the hammer weld 153 is structured and configured as a slot for receiving a traversing portion of the slide component 120 (best seen in FIG. 8). The traversing aperture 159 may, however, be generally defined by any shape so long as its mechanical engagement with the slide component 120 allows for a user to readily and easily manipulate the hammer sub-component 150, at least in part, by the side handle with threaded stud 151.

The hammer weld 153 is terminated by the impact washer 155 at one end proximate the anvil-subcomponent 141. At the other end, proximate the support component 130, the hammer weld 153 is terminated by the rubber bumper 157. The hammer weld 153 may be made of, or comprise, other sub-components, structures, and/or features configured to facilitate the slidable, mechanical interaction between the hammer weld 152 and the slide component 101. Moreover, the hammer weld 153 may be made of, or comprise, other sub-components, structures, and/or features configured to facilitate or improve the mechanical impacts of the hammer sub-component 150 as it strikes and slides between the anvil sub-component 141 and the support component 130 (e.g., paddings, insulations, dampeners, etc. regardless of whether they are made of plastics, composites, ceramics, synthetic materials).

Figure 14:
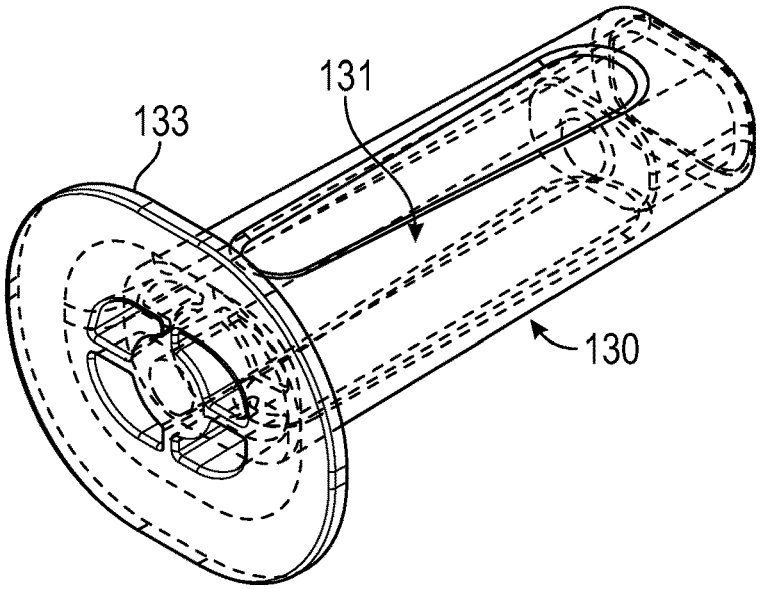
FIG. 14 is a perspective view of the exploded support component of FIG. 8.
Figure 15:
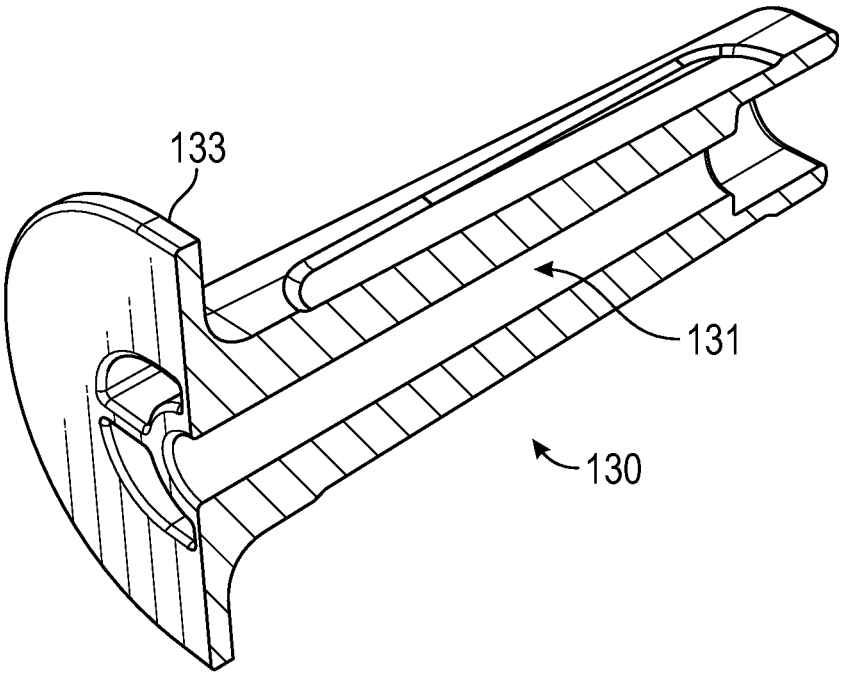
FIG. 15 is a sectional left side view of the exploded support component of FIG. 8.

Referring now to FIGS. 14 and 15, a perspective view and a sectional left side view of the exploded support component 130 of FIG. 8 are shown. The exemplary embodiment illustrated in FIGS. 14 and 15 are similar to the exemplary embodiment illustrated in FIG. 8 and, therefore, only the differences between these exemplary embodiments are described.

As previously stated, the support component 130 of the slide-hammer 100 is an elongate handle defining the traversing aperture 131. The support component 130 is structured and configured as having a slot for receiving the threaded end 121*b* of the slide component 120. More specifically, the support component 130 is terminated at one end by an exemplary embodiment of a handle flange 133. The handle flange 133 extends laterally away from the support component 130, at one end, while the remainder of the support component 130 defines an ergonomic grip. In this way, the remainder of the support component 130 is configured as the support handle for holding the assembled slide-hammer 100 during mechanical operation of the hammer sub-system 150 along the slide component 101. The handle flange 133, therefore, prevents the end-user from losing his or her grip and sliding forward towards any mechanically dynamic components or sub-systems. The handle flange 133 may be made of, or comprise, other sub-components, structures, and/or features configured to improve the ergonomic or comfort qualities of the handle.

Figure 16:
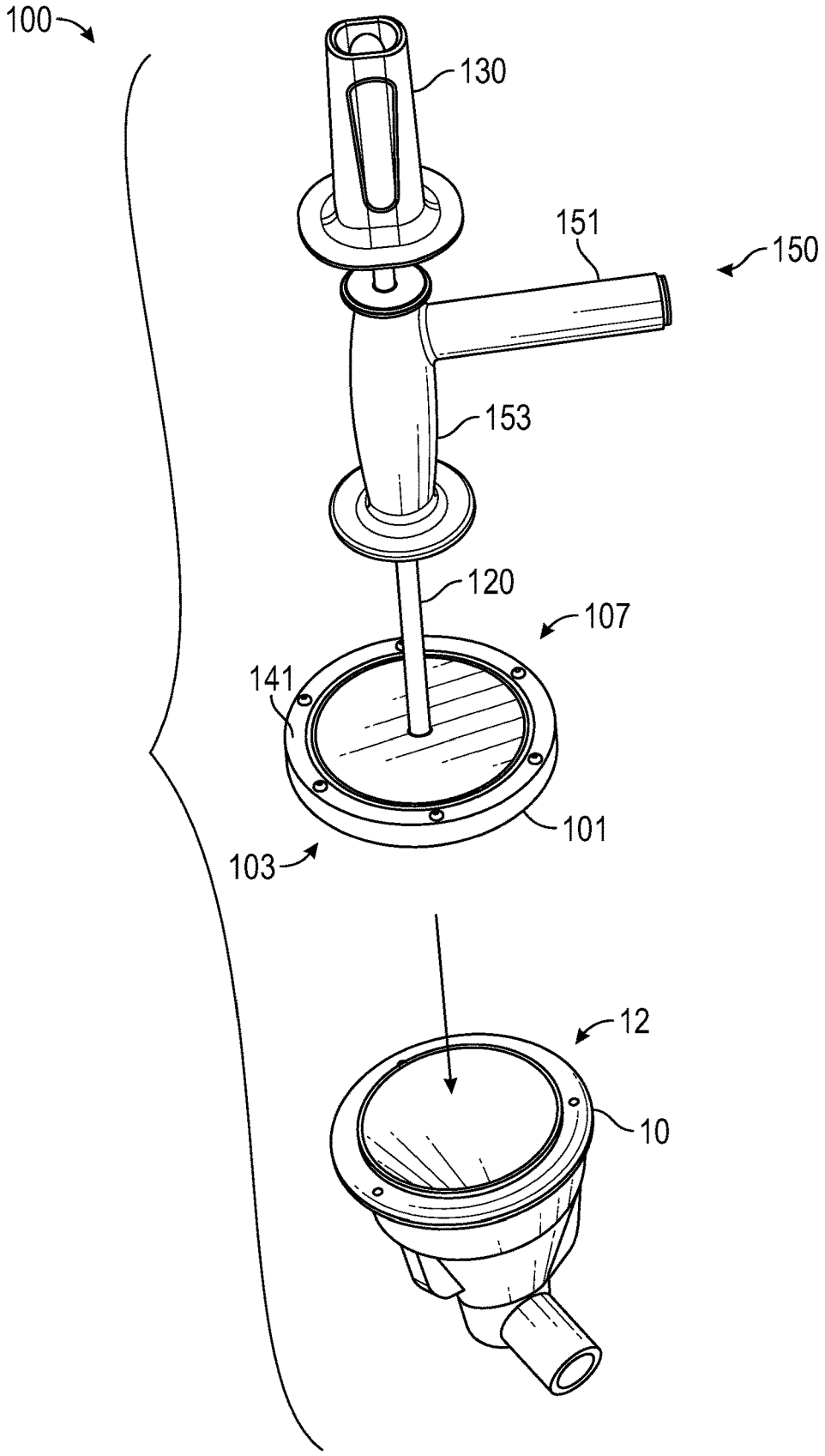
FIG. 16 is a perspective right side view of the assembled slide-hammer of FIG. 1 acting on an exemplary example of a jet body housing.

Referring now to FIG. 16, a perspective right side view of the assembled slide-hammer of FIG. 1 is shown acting on an exemplary example of a housing 10. The exemplary embodiment illustrated in FIG. 16 is similar to the exemplary embodiment illustrated in FIG. 1 and, therefore, only the differences between these exemplary embodiments are described.

As previously stated, the slide-hammer 100 is configured to drive the housing 10 into a grommet (not shown in FIG. 16, but shown starting with FIG. 18A as grommet 22) via a succession of consistent and repeatable strikes or impacts, wherein each successive strike or impact imparts an insertion force. The slide-hammer 100, depending on how it is manually used by the end-user, may impart substantially equivalent insertion forces. This is advantageous if predictable and repeatable installation practices involving the tool are desired by the end-user. In other exemplary embodiments, however, an end-user may use the tool with variable stroke lengths to generate a succession of consistent and repeatable strikes or impacts of variable magnitudes.

More specifically, the housing engagement component 101 of the slide-hammer 100 may be engaged up against the opening perimeter 12 of the housing 10. Even though the housing 10 is a first size, the housing engagement component 101 is configured to engage with variously sized housings (best seen in FIGS. 18A-18D showing exemplary embodiments of a jet body housing) via the stepped regions 105. One of ordinary skill in the art understands that each stepped region 105, with its decreasing diameter and increasing height, facilitates the stepped tip 103 being a one-size-fits-all or one-size-fits-most device for use with most industry standard housing sizes.

Once the housing engagement component 101 of the slide-hammer 100 is engaged up against the opening perimeter 12, the housing engagement component 101 maintains the position and alignment with the housing 10 such that any generated insertion force is translated and imparted onto substantially the same place along the opening perimeter 12 of the housing 10. In this way, namely, by the user holding the slide hammer 100 against the housing 10, the housing engagement component 101 symmetrically engages all the way around the opening perimeter 12, although other exemplary embodiments may engage asymmetrically. In this way, the slide-hammer 100 is configured to translate and impart the insertion force from the insertion force generating sub-system 140 to the housing 10.

More specifically, once the user causes the hammer sub-system 150 to slidably reciprocate about the set stroke relative to the anvil component 141, the hammer sub-system strikes the anvil component 141 and translates an insertion force through the anvil component 141, to the housing engagement component 101, and then to the housing 10. During use, the slide-hammer 100 maintains the substantially the same position and alignment relative to the housing 10 such that every insertion blow is translated and imparted onto substantially the same place along the opening perimeter 12, and such that the slide-hammer 100 does not substantially wobble.

Furthermore, once the housing engagement component 101 of the slide-hammer 100 is engaged up against the opening perimeter 12, an end-user may manually operate the slide-hammer 100 with one hand on the support component 130 and one hand on the handle 151 sub-component of the hammer sub-system 150. The end-user may firmly grasp and press the housing engagement component 101 into detachable engagement with the housing 10. The end-user may then firmly grasp the handle 151 sub-component to stroke/slide the hammer sub-system 150 about the traversing slide component 120. Once tamping is completed, the end-user may cease stroking or sliding, and then pull the housing engagement component 101 out of engagement with the opening perimeter 12.

Figure 17:
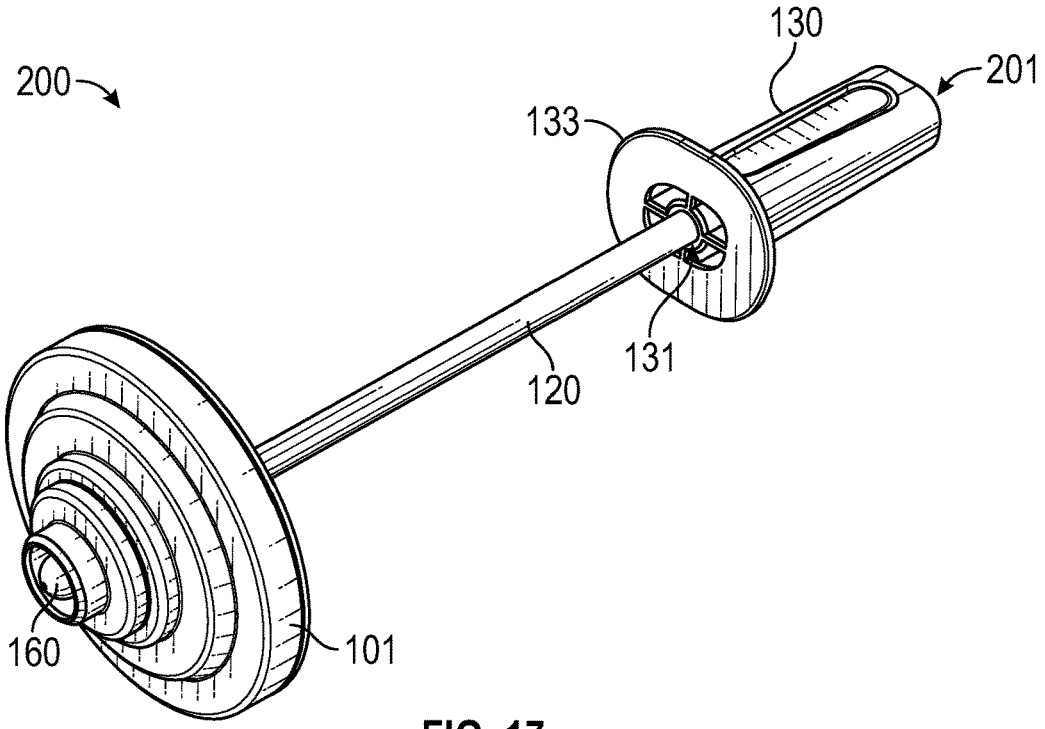
FIG. 17 is a perspective left side view of a second exemplary embodiment of an assembled installation tool of the present invention.
Figure 18A:
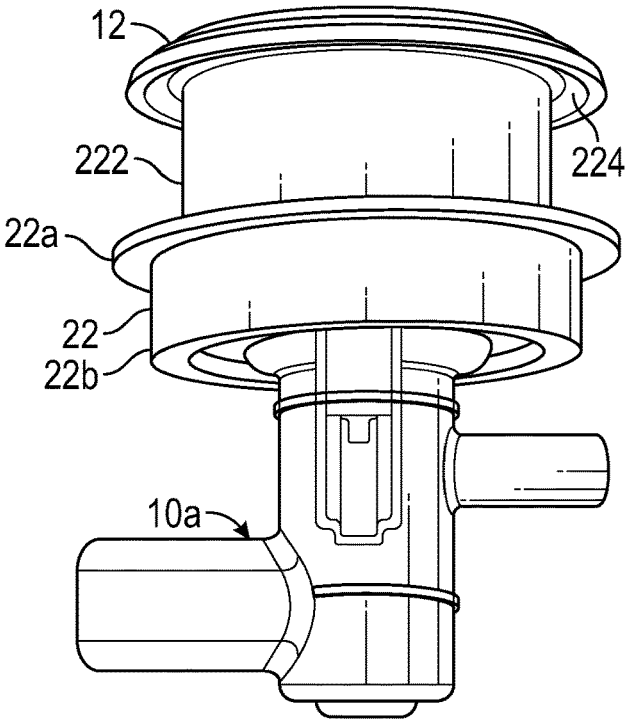
FIG. 18A is a perspective left side view of a first exemplary embodiment of a jet body housing.
Figure 18B:
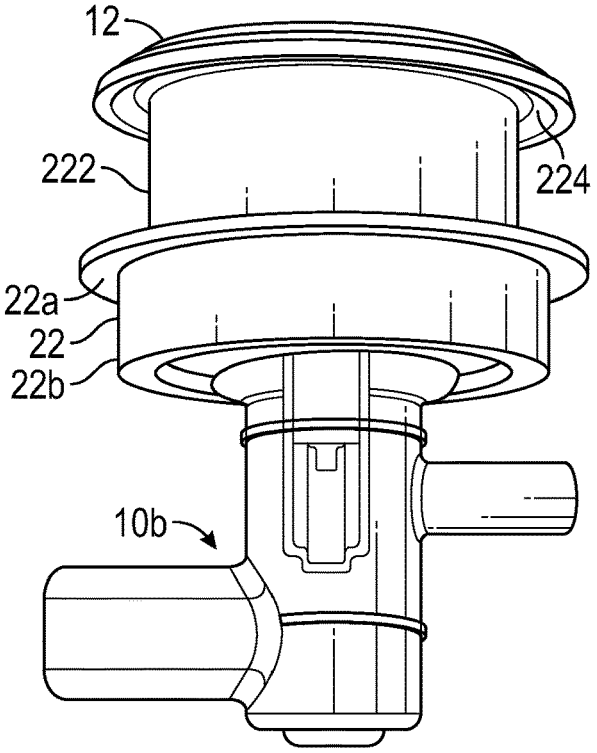
FIG. 18B is a perspective left side view of a second exemplary embodiment of a jet body housing.
Figure 18C:
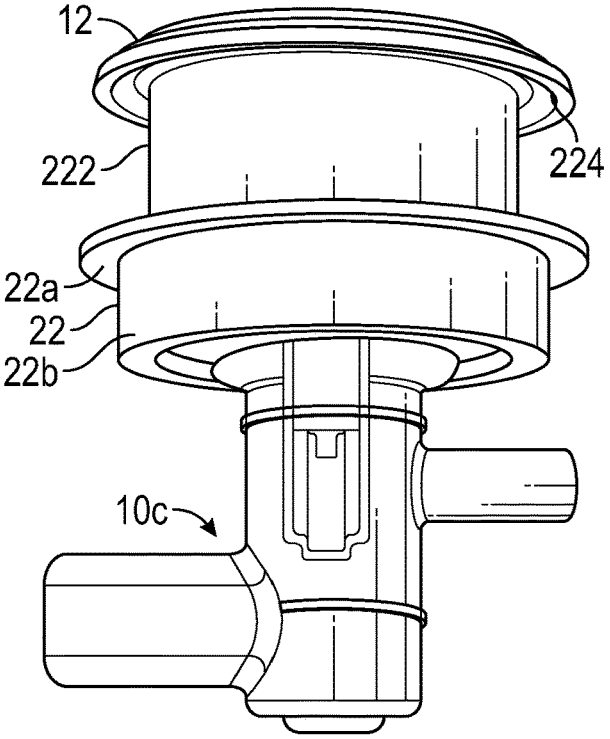
FIG. 18C is a perspective left side view of a third exemplary embodiment of a jet body housing.
Figure 18D:
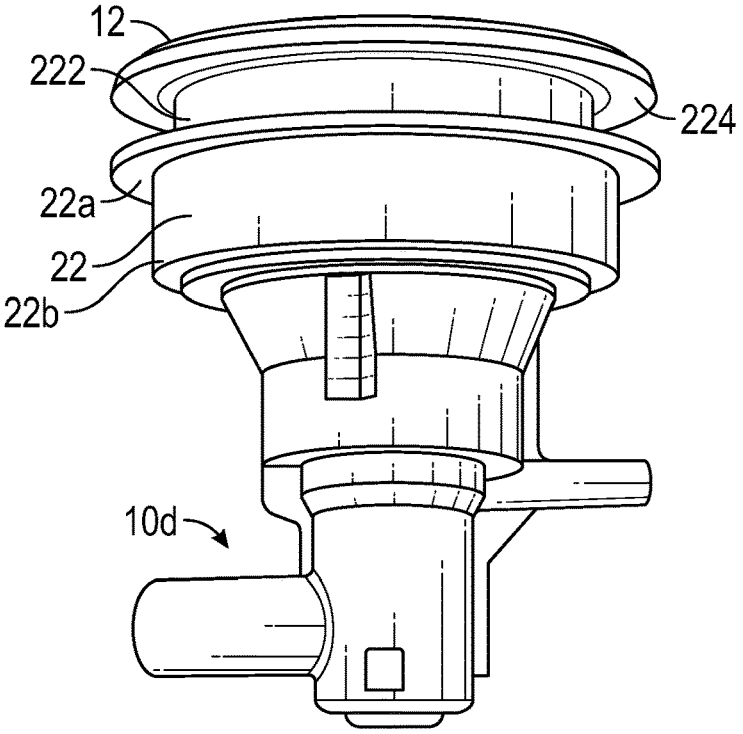
FIG. 18D is a perspective left side view of a fourth exemplary embodiment of a jet body housing.

Referring now to FIG. 17, a perspective left side view of a second exemplary embodiment of a tamp of the present disclosure is shown. The second exemplary embodiment of the tamp being in one exemplary embodiment of a tamp-for-hammer configuration 200. The second exemplary embodiment illustrated in FIG. 17 is similar to the first exemplary embodiment illustrated in FIGS. 1-16 and, therefore, only the differences between these exemplary embodiments are described.

The tamp-for-hammer 200 comprises one exemplary embodiment of the housing engagement component 101, the slide component 120, a support component 130, and an assembly sub-system 160. The exemplary embodiment of the slide component 120 is configured as a shortened stem relative to the exemplary embodiment of the slide component 120 of FIGS. 1-16. Moreover, the exemplary embodiment of the support component 130 is configured as an anvil handle configured to receive at least a portion of the insertion force via a manually powered hammer strike, for example.

The slide component 120 of the tamp-for-hammer 200 also is a one piece, monolithic component with embedded sub-components or regions. More specifically, the slide component 120 is an elongate, rigid, cylindrical rod terminated by an exemplary embodiment of threading 121 at opposite ends. In another exemplary embodiment, the slide component 120 may be terminated by dampening and attachment regions, with the dampening and attachment regions being configured as a means for mechanically attaching the jet body housing engagement component 101, at one end, and the anvil handle 130, at the opposite end. The dampening and attachment regions also being configured as a means for dampening and/or modulating the insertion force to be translated translated through the assembled tamp 200 when a rubber mallet, for example, strikes the support component 130. In this way, the slide component 120 is structured and configured as a shortened stem for the assembled tamp-for-hammer 200.

When assembled with the housing engagement component 101 and the support component 130, the shortened tamp stem 120 structurally supports, at least in part, the various components, sub-systems, structures, and/or features of the tamp-for-hammer 200. More specifically, the slide component 120 centrally traverses the individual components or sub-systems and is, therefore, positioned parallel to the central longitudinal axis of the assembled tamp-for-hammer 200. The slide component 120 may be made of, or comprise, other sub-components, structures, and/or features configured to facilitate the support function, or to facilitate translation of any insertion force to be translated through the assembled tamp 200, or to facilitate dampening/modulation of the insertion force translated there through.

The support component 130 of the tamp-for-hammer 200 also is an elongate component with embedded sub-components or regions. More specifically, the support component 130 is an exemplary embodiment of a handle piece defining an exemplary embodiment of traversing aperture 131, and terminated by an exemplary embodiment of an anvil region 201. The anvil region 201 is an exemplary embodiment of a planar impact zone. When assembled with the jet body housing engagement component 101, the slide component 120, and the assembly sub-system 160, the anvil region 201 of the support component 130 is structured and configured to receive any impact or strike carrying an insertion force.

The anvil region 201 of the support component 130 may be made of, or comprise, other sub-components, structures, and/or features configured to facilitate and/or modulate and/or dampen the force translation from the anvil region 201 to the rest of the support component 130 and to the slide component/stem 120. Moreover, the anvil region 201 generally defines a planar surface that facilitates receiving impacts from a rubber mallet, for example. Moreover, the support component 130, with its smooth traversing aperture 131, is also structured and configured as a slot for receiving a traversing portion of the slide component 120 at the threaded end, for example.

It is envisioned that a rubber tamping mallet, for example, may mechanically cooperate, interact, or engage with the anvil region 201 of the support component 130 such that any insertion force manually applied by a hammer stroke on the anvil region 201 ultimately translates to the housing engagement component 101. In this way, the support component 130 translates any generated insertion force throughout the assembled tamp 200.

The support component 130 also is terminated at one end, opposite the anvil region 201, by an exemplary embodiment of a handle flange 133. The handle flange 133 extends laterally away from the support component 130 while the remainder of the support component 130 defines an ergonomic grip between the handle flange 133 and the anvil region 201. In this way, the remainder of the anvil handle 130 is configured as the support handle for holding and manipulating and positioning the assembled tamp-for-hammer 200. The handle flange 133, therefore, prevents the end-user from losing his or her grip when the assembled tamp-for-hammer 200 is receiving hammer strikes, for example.

As previously stated, the assembled tamp-for-hammer 200 is configured to drive the housing 10 into a grommet via a succession of consistent and repeatable strikes or impacts, wherein each successive strike or impact imparts an insertion force. The tamp-for-hammer 200, depending on how it is manually used by the end-user, may impart a substantially equivalent insertion force that can be more precisely controlled than the first exemplary embodiment of the tamp of FIGS. 1-16. An average end-user may operate the tamp-for-hammer 200 in tandem with the slide-hammer 100 embodiment (one after the other, for example), or as a substitute for the slide-hammer 100 embodiment. For example, an end-user may begin the process with the slide-hammer 100 embodiment (because it may be easier to initially insert the grommet with the slide-hammer) and then finish precisely inserting the process with the tamp-for-hammer 200 embodiment (because it may be easier to finish precise insertion with only the minimum amount of force with the tamp-for-hammer). The tamp-for-hammer 200 embodiment may be more desirable to use when installing components within tight spaces or corners of the tub or spa.

Even though the basic tamp configuration may require the use of a separate traditional rubber mallet, the basic tamp configuration embodiment remains structured and configured to create substantially the same insertion force from every successive insertion strike or impact, and to translate and impart the insertion force by maintaining the position and alignment with the housing 10. As such, any generated insertion force for the basic tamp configuration may be translated and imparted onto substantially the same place along the opening perimeter 12 of the housing 10 and in substantially the same direction.

More specifically, the housing engagement component 101 of the tamp-for-hammer 200 may be engaged up against the opening perimeter 12 of the housing 10. Once the housing engagement component 101 is engaged up against the opening perimeter 12, the housing engagement component 101 maintains the position and alignment with the housing 10 such that any insertion force applied is translated and imparted onto substantially the same place along the opening perimeter 12 of the housing 10. In this way, namely, by the user holding the tamp-for-hammer 200 against the housing 10, the housing engagement component 101 symmetrically engages all the way around the opening perimeter 12. Then, once the end-user causes a hammer strike, for example, on the anvil region 201 of the support component 130, the assembled tamp-for-hammer 200 translates the insertion force through the slide component/stem 120 to the housing engagement component 101 and then to the housing 10. During use, the tamp-for-hammer 200 maintains substantially the same position and alignment relative to the housing 10 such that every insertion blow is translated and imparted onto substantially the same place along the opening perimeter 12, and such that the tamp-for-hammer 200 does not substantially wobble.

Referring now to FIGS. 18A-18D, perspective left side views of various exemplary embodiments of housings 10 for jets are shown. Jet body housings 10*a*-10*d* each, respectively, comprise a opening perimeter 12 as is understood by one of ordinary skill in the art. In FIGS. 18A-18D, grommet 22 is shown in an initial position for illustrating the general positioning of a grommet onto a portion of the housing 10. Grommet 10 is slidable along the cylindrical portion 222 shown and, when housing 10 is installed onto the sidewall 310 of the water containing structure, grommet 22 abuts against the lower surface 224 of the opening perimeter 12, as shown in more detail in FIGS. 19A-19E and FIGS. 26-28.

Figure 19A:
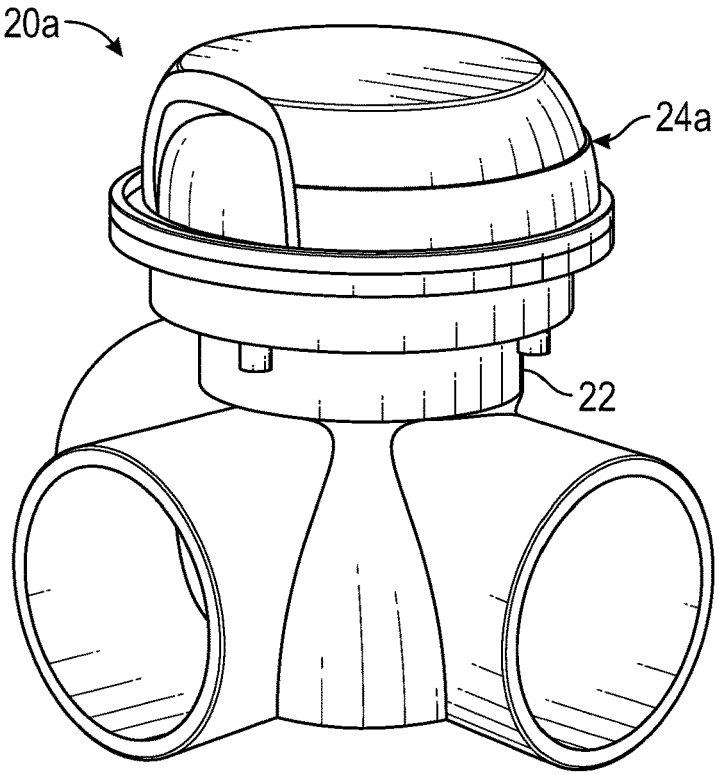
FIG. 19A is a perspective view of an exemplary embodiment of a diverter valve assembly with grommet.
Figure 19B:
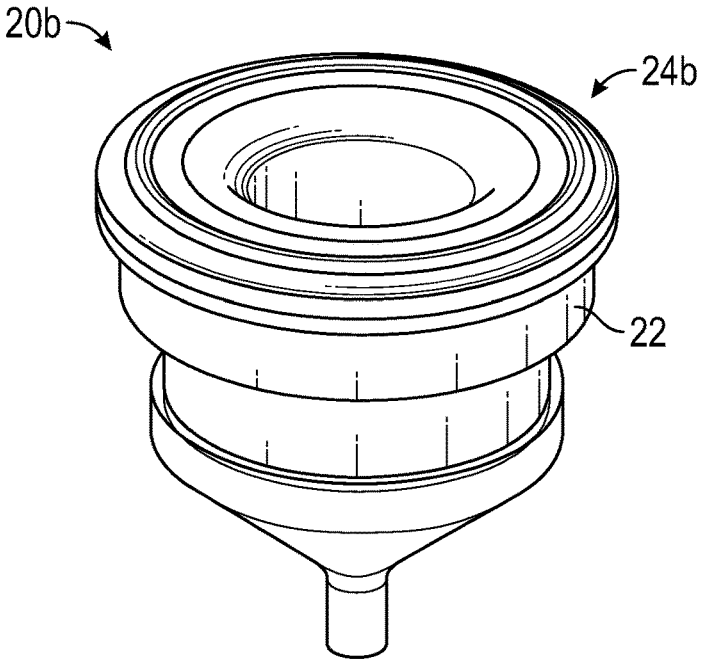
FIG. 19B is a perspective view of an exemplary embodiment of a cup holder light with grommet.
Figure 19C:
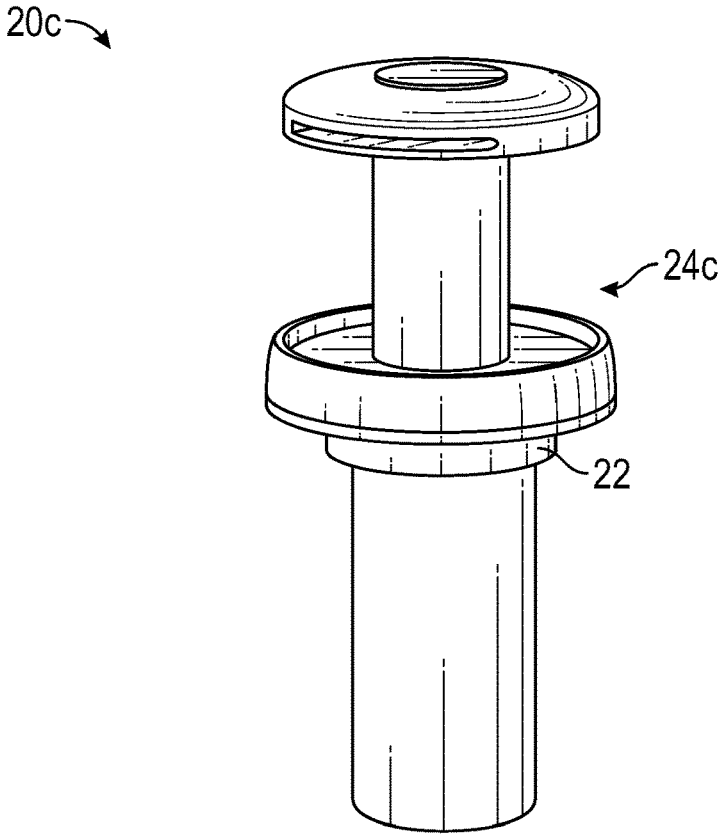
FIG. 19C is a perspective view of an exemplary embodiment of a pop-up lighted fountain with grommet.
Figure 19D:
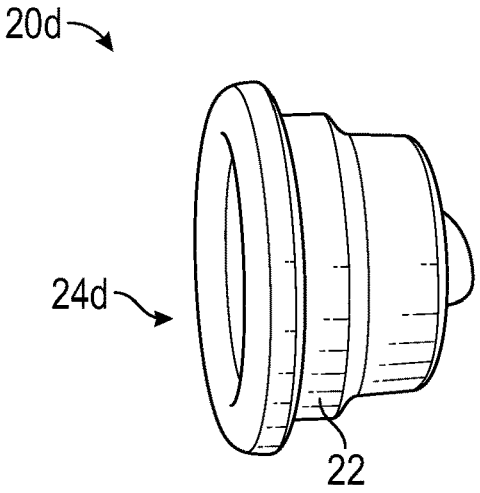
FIG. 19D is a perspective view of an exemplary embodiment of a spa light with grommet.
Figure 19E:
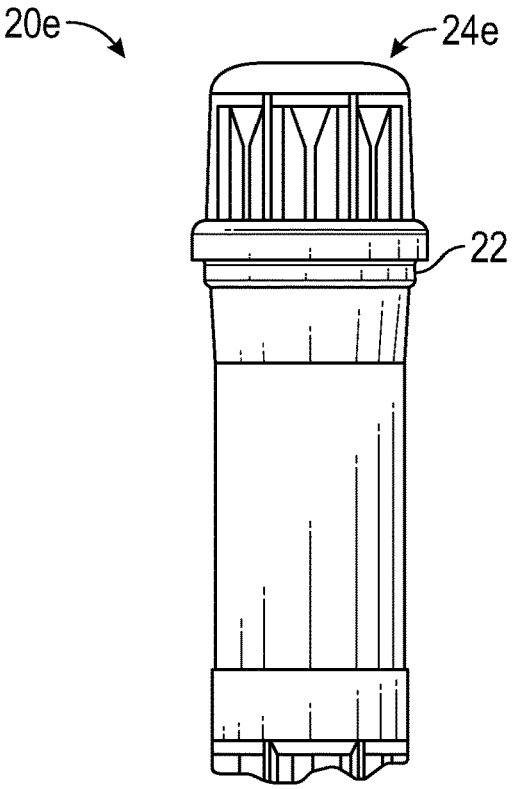
FIG. 19E is a perspective view of an exemplary embodiment of a spa filter with grommet.

Referring now to FIGS. 19A-19E, perspective views of various exemplary embodiments of other components and sub-systems for a water containing structure, other than jets, involving a grommet are shown. FIG. 19A is a perspective view of an exemplary embodiment of a diverter valve assembly with a grommet. FIG. 19B is a perspective view of an exemplary embodiment of a cup holder light with a grommet. FIG. 19C is a perspective view of an exemplary embodiment of a pop-up lighted fountain with a grommet. FIG. 19D is a perspective view of an exemplary embodiment of a spa light with a grommet. FIG. 19E is a perspective view of an exemplary embodiment of a spa filter with a grommet. These grommet-features 20*a*-20*e* each, respectively, comprise an exemplary embodiment of a grommet 22 and an engagement portion/region 24. In FIGS. 19A-19E, the sidewall 310 of the water containing structure is not shown, and the grommet 22 is shown pressed up against the other component. As will be understood by those of ordinary skill in the art, the sidewall 310 of the water containing structure will be sandwiched between the grommet 22 and the engagement portion/region 24*a*-24*e* of the other component.

Figure 20:
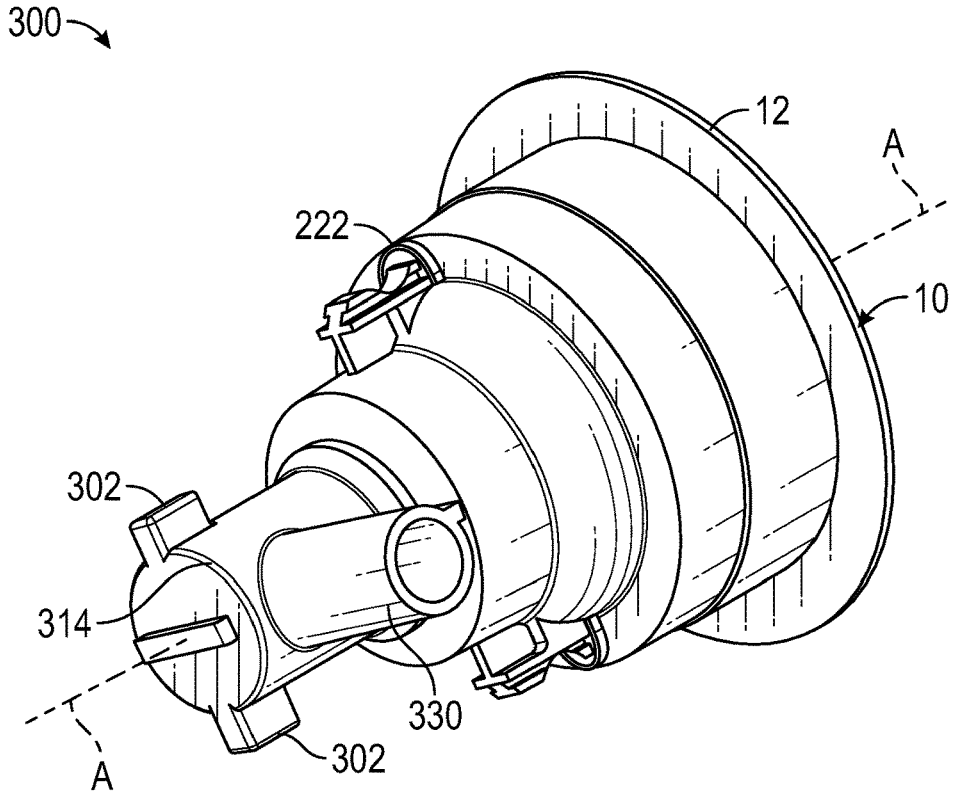
FIG. 20 is a perspective view of an exemplary embodiment of a jet housing including tabs for engagement with a puller tool.
Figure 21:
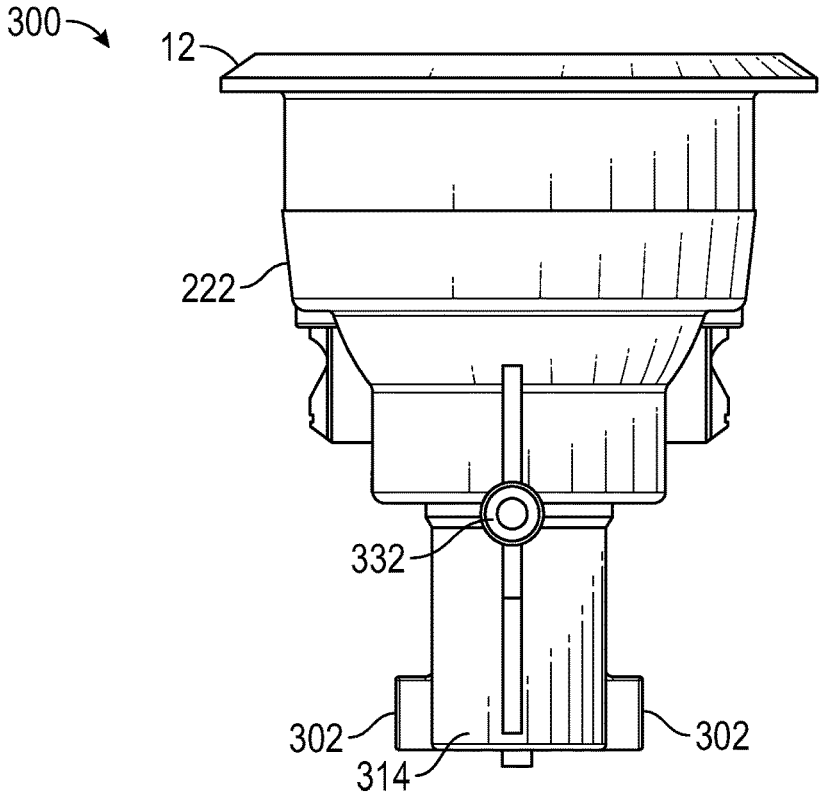
FIG. 21 is a side view of an exemplary embodiment of a jet housing including tabs for engagement with a puller tool.
Figure 22:
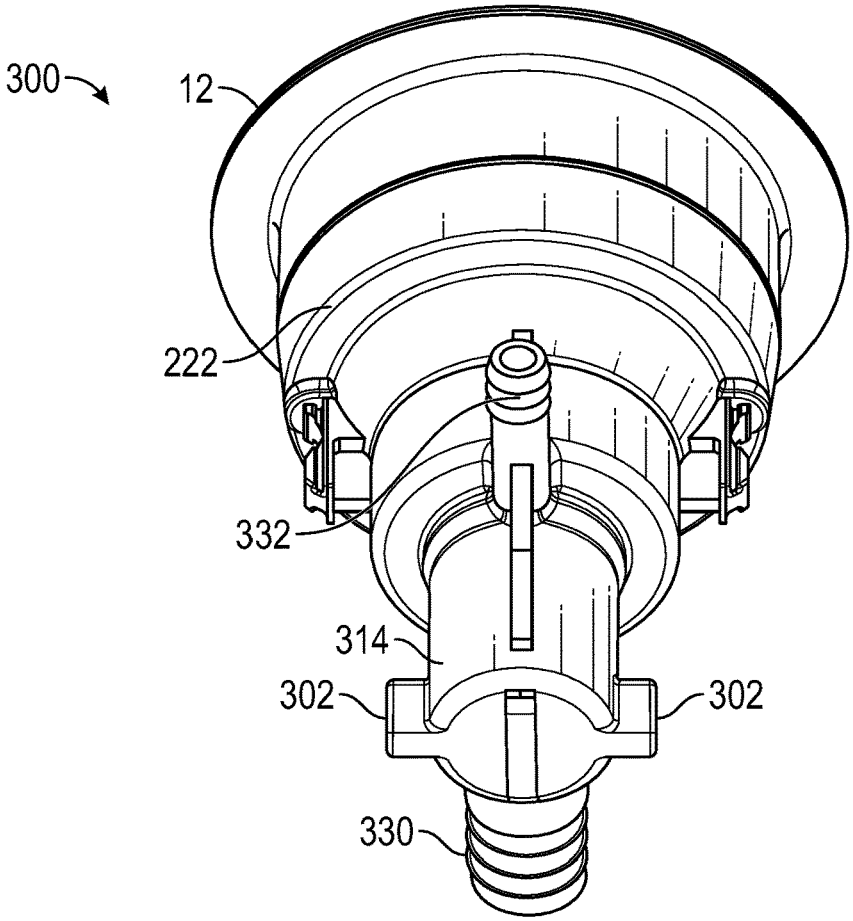
FIG. 22 is a side perspective view of an exemplary embodiment of a jet housing including tabs for engagement with a puller tool.

Referring now to FIGS. 20-22, an exemplary embodiment of a jet housing 300 suitable for use with any embodiment of the installation tool 100 is shown. The exemplary embodiment shown in FIGS. 20-22 comprises ears or tabs 302 for engagement by a puller tool 200, as shown in FIGS. 23-28. FIG. 20 is a perspective view of an exemplary embodiment of jet housing 300 with tabs 302 for engagement with a puller tool 200. FIG. 21 is a side view of an exemplary embodiment of jet housing 300 including tabs 302 for engagement with a puller tool 200. FIG. 22 is a side perspective view of an exemplary embodiment of jet housing 300 including tabs 302 for engagement with a puller tool 200.

A non-limiting and exemplary embodiment of a housing 10 takes the form of a jet housing 300 for mounting a water jet (not shown) onto the sidewall 310 of a water containing structure. An exemplary jet housing 300 is a known or available housing 10 comprising a single- or multi-tiered cylindrical portion 222, a water inlet 330, an air inlet 332, and an opening perimeter 12. Grommet 22 is not shown in FIGS. 20-22, but can be seen in FIGS. 26-28. A representative jet housing 300 suitable for use with certain embodiments of the present invention further comprises tabs 302 or ears for engagement by the puller tool 200. More specifically, the end of the housing 300 that extends through the opening 312 in the sidewall 310 of the water containing structure comprises the tabs 302 or ears, which typically take the form of protrusions from the surface 314 of the housing 300 preferably normal to or at least obtuse to the axis A of the major cylindrical portion 222 of the housing 300.

The tabs 302 or ears are of such a size and shape that the tabs 302 or ears cooperate with the puller tool 200, as disclosed herein. Preferably, there are two tabs 302 or ears, although one, three, or more tabs 302 or ears can be included and utilized. With two tabs 302 or ears, the tabs 302 or ears preferably are located diametrically opposite each other on the surface of the major cylindrical portion 222 of the housing 300. The jet housing 300 comprising the tabs 302 or ears can be used with any of the disclosed embodiments of the installation tool 100, with or without the pulling tool 200, as the tabs 302 or ears will not interfere with the operation of the installation tool 100.

Figure 23:
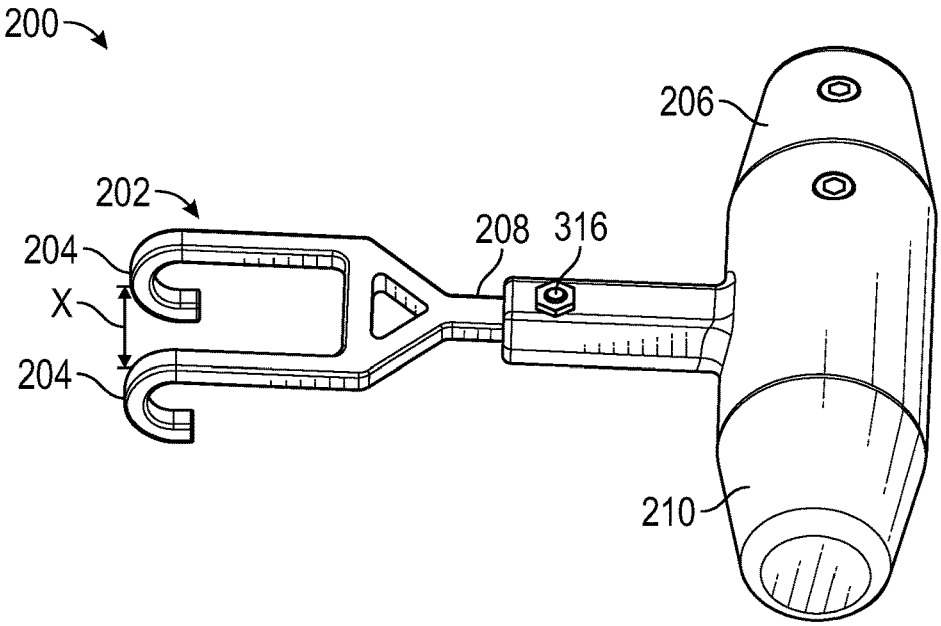
FIG. 23 is a perspective view of an exemplary embodiment of a puller tool.
Figure 24:
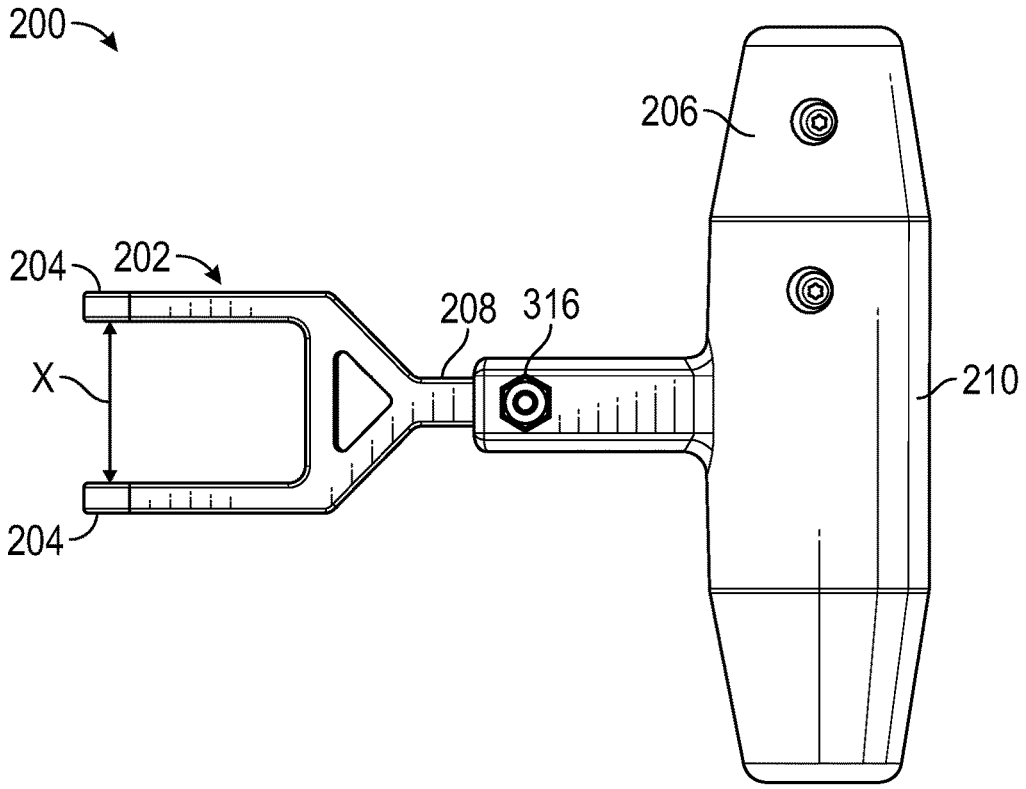
FIG. 24 is a top view of an exemplary embodiment of a puller tool.
Figure 25:
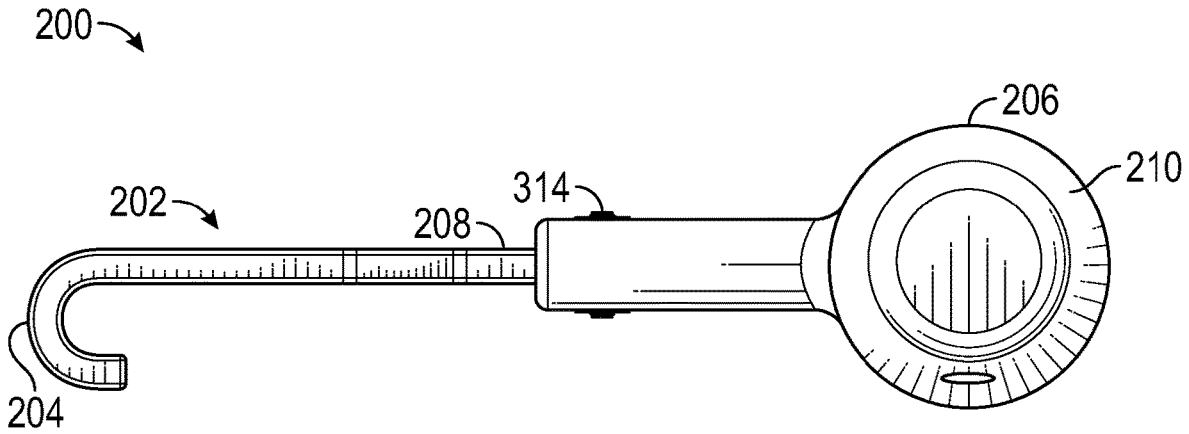
FIG. 25 is a side view of an exemplary embodiment of a puller tool.

Referring now to FIGS. 23-25, an exemplary embodiment of an installation tool 100 in the form of a puller tool 200 suitable for use with a housing embodiment such as jet housing 300 is shown. The exemplary embodiment shown in FIGS. 23-25 comprises hooking portion 202 with hooks 204, handle 206, and a stem 208 for connecting hooking portion 202 and/or hooks 204 to handle 206. FIG. 23 is a perspective view of an exemplary embodiment of puller tool 200. FIG. 24 is a top view of an exemplary embodiment of puller tool 200. FIG. 25 is a side view of an exemplary embodiment of puller tool 200.

The exemplary embodiment of the installation tool 100 taking the form of a puller tool 200 comprises the hooking portion 202 for hooking onto tabs 302 or ears on a housing 100, such as jet housing 300 to be mounted in the sidewall 310 of the water containing structure, and the handle 206 for pulling the housing 10, 300 along with an associated grommet 22 into an opening 312 in the sidewall 310 of the water containing structure for mounting.

The hooking portion 202 typically comprises at least one and preferably two hooks 204 for engaging at least one tab 302 or ear and preferably two tabs 302 or ears on the housing 10, 300. The hooks 204 can be simple semi-circles sized and structured to fit around the tabs 302 or ears on the housing 10, 300. The hooks 204 are attached to a stem 208 that attaches to the handle 206, or are attached directly to the handle 206.

The handle 206 typically comprises a generally cylindrical structure that a user can grip with one or two hands, preferably one hand. As such, the outer surface of the handle portion preferably has a curved and smooth surface 210 for more comfortable use.

The hooking portion 202 is attached to and extends from the handle 206 in a generally normal direction whereby a user can grasp the handle 206 and manipulate the hooking portion 202. The handle 206 and the hooking portion, and the stem 208 if present, can be a single element or, as shown in FIGS. 23-25, at least two separate components connected by a fastener, such as nut and bolt 316. If two separate components, hooking portion 202 can be removed from handle 206. This can be advantageous as holing portion can be made in various sizes to accommodate various diameters of various housings 10, 300. For example, cylindrical portion 222 of housing 10, and more specifically the end of housing 10, 300 on which tabs 302 or ears are mounted, are of various sizes depending on the component (jet, cup holder, valve, switch, etc.) or jet (large, medium, small, water-only, aerated, etc.) to be used. In this manner, hooking portions 202 having larger or smaller hooks 204 and/or larger or smaller distances X between hooks 204, can be manufactured and used with only one handle 206.

In use, the user grasps the handle 206, maneuvers the hooking portion 202 to engage the tabs 302 or ears on the housing 10, 300, and then pulls the housing 10, 300 through an opening 312 in a wall or the sidewall 310 of the water containing structure whereby the grommet 22 surrounding a portion, typically cylindrical portion 222, of the housing 10, 300 engages with the inner surface of the opening 312 in the wall or sidewall 310 of the water containing structure, thereby causing the housing 10, 300 to be mounted within the opening 312 in the wall or sidewall 310 of the water containing structure in a friction fitting manner.

Figure 26:
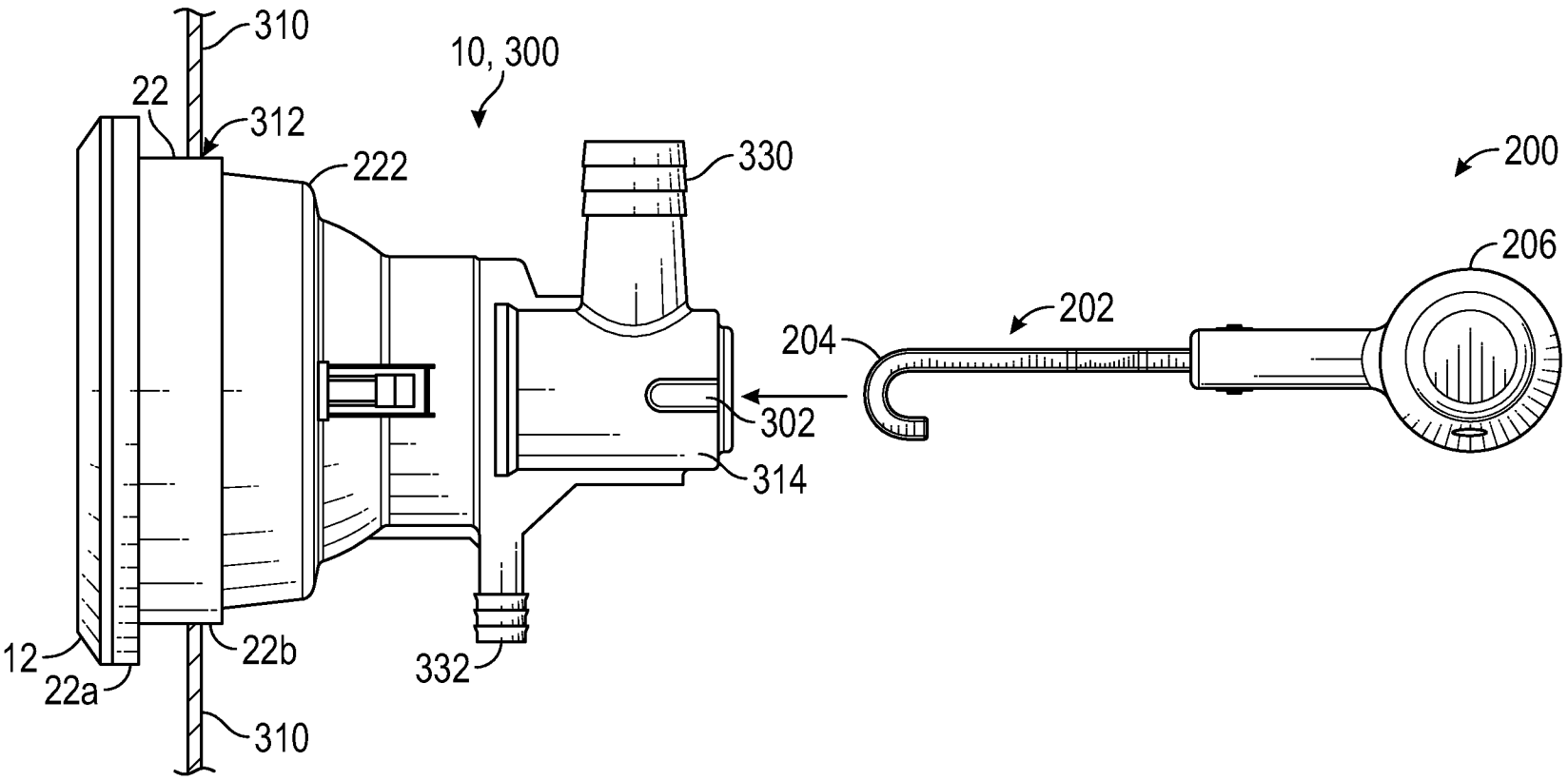
FIG. 26 is a side view of an exemplary embodiment of a puller tool in preparation for engagement with a jet housing including tabs.
Figure 27:
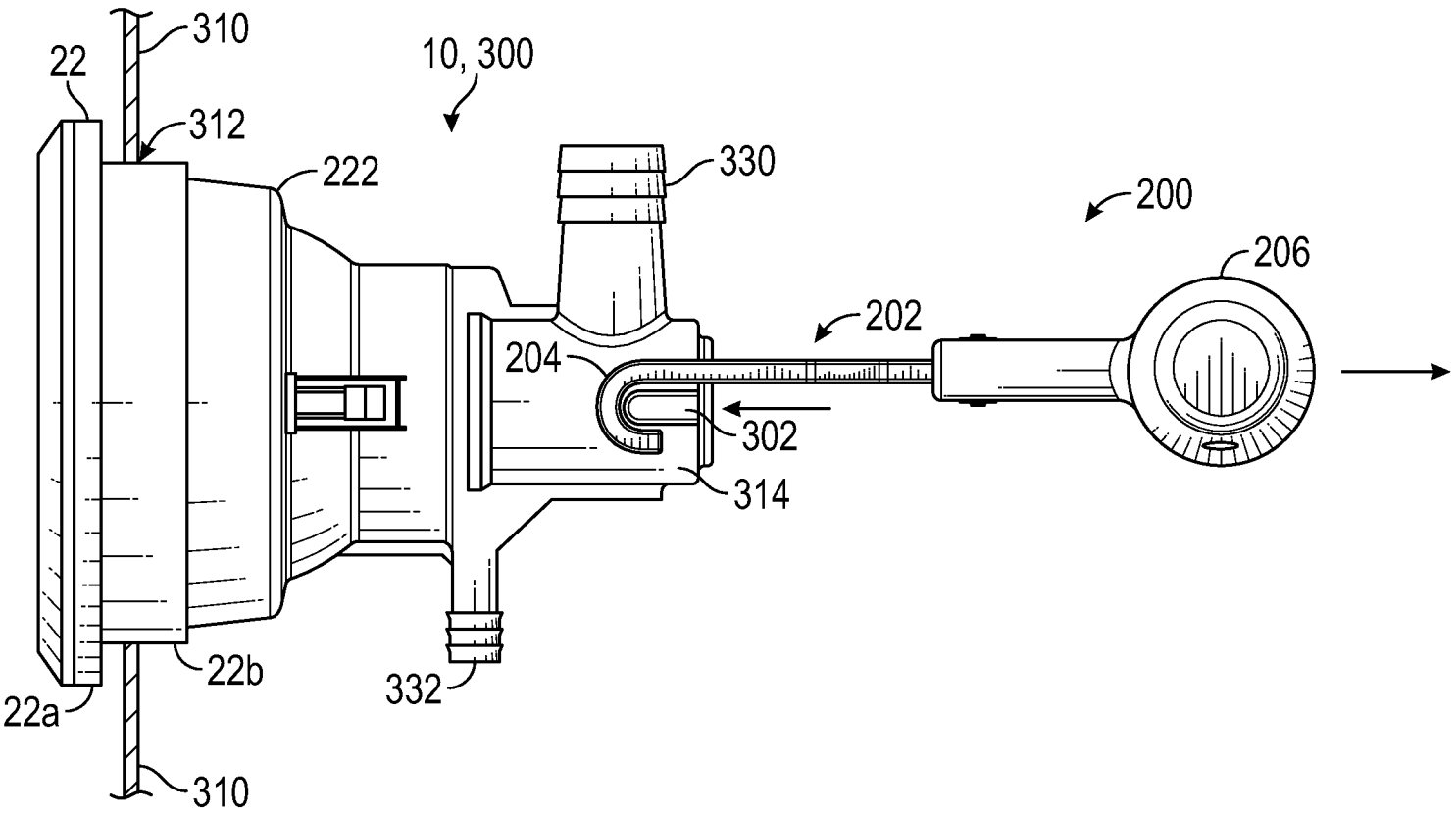
FIG. 27 is a side view of an exemplary embodiment of a puller tool in engagement with a jet housing including tabs.
Figure 28:
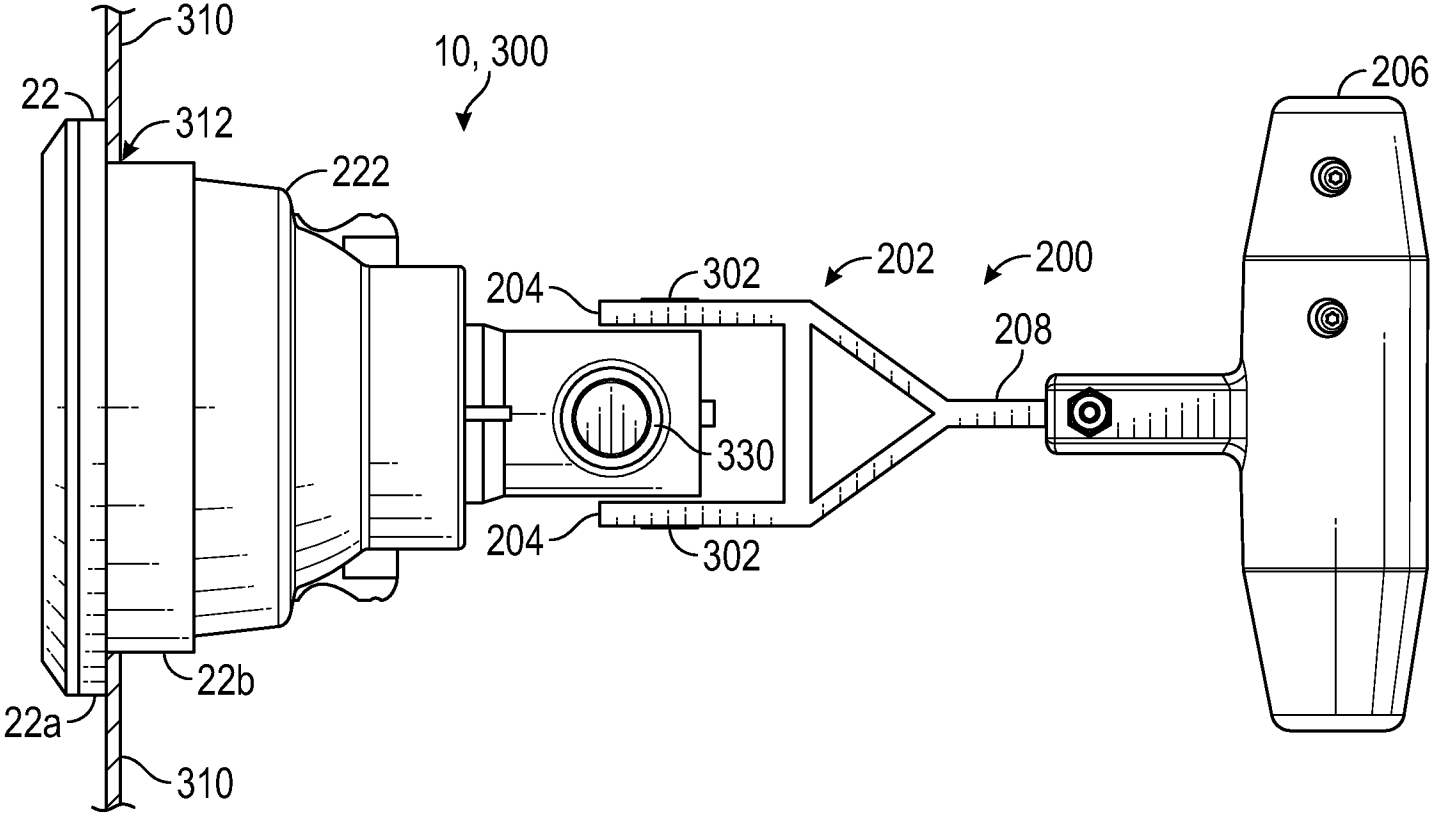
FIG. 28 is a front view of an exemplary embodiment of a puller tool in engagement with a jet housing including tabs.

Referring now to FIGS. 26-28, an exemplary embodiment of a puller tool 200 in engagement with a suitable housing 10 in the form of jet housing 300 is shown in use. FIG. 26 is a side view of an exemplary embodiment of puller tool 200 in preparation for engagement with jet housing 300 including tabs 302. FIG. 27 is a side view of an exemplary embodiment of puller tool 200 in engagement with jet housing 300 including tabs 302. FIG. 28 is a front view of an exemplary embodiment of puller tool 200 in engagement with jet housing 300 including tabs 302.

The puller tool 200 is used to grab the tabs 302 or ears on the jet housing 300 so as to allow one the user to pull the jet housing 300 through the grommet 22 from the dry side of the water containing structure. This often is done as the jet housing 300 is being tapped in from the front side (wet side) of the water containing structure with a rubber mallet or with the installation tool 100. Thus, the puller tool 200 can be used separately, along with a convention al rubber mallet, and/or along with another installation tool as disclosed herein. In this manner, the puller tool 200 can be used as the primary installation tool 100, or as an assist to a different primary installation tool 100 as disclosed herein, such as the slide hammer or the tamp-for-hammer.

FIGS. 26-28 show the puller tool 200 in three stages of use. FIG. 26 illustrates maneuvering the hooking portion 202 to engage the tabs 302 or ears on the housing 10, 300. In FIG. 26, the housing 300 is shown partially through (about one-third) the opening 312 of the sidewall 310 of the water containing structure, as illustrated by the grommet 22 being about one-third through the opening 312. FIG. 27 illustrates the hooks 204 cooperating with, or hooking, the tabs 302 or ears of the housing 300, and then pulling the housing 10, 300 through the opening 312 in the wall or the sidewall 310 of the water containing structure. In FIG. 27, the housing 300 is shown partially through (about two-thirds) the opening 312 of the sidewall 310 of the water containing structure, as illustrated by the grommet 22 being about two-thirds through the opening 312. FIG. 28 illustrates the hooks 204 cooperating with, or hooking, the tabs 302 or ears of the housing 300, with the housing and grommet 22 in final mounting engagement with the sidewall 310 of the water containing structure. In FIG. 28, the housing 300 is shown fully through the opening 312 of the sidewall 310 of the water containing structure, as illustrated by the grommet 22 being flush with the sidewall 310. At this point, the puller tool 200 is disengaged from the tabs 302 or ears and therefore from the housing 300.

As the housing 10, 300 is being mounted in the opening 312 of the sidewall 310 of the water containing housing, the grommet 22 surrounds a portion, typically cylindrical portion 222, of the housing 10, 300 and engages with the inner surface of the opening 312. When fully mounted as shown in FIG. 28, the housing 10, 300 is mounted within the opening 312 in the wall or sidewall 310 of the water containing structure in a friction fitting manner, with a flange portion 22*a* of the grommet 22 flush with the inner (wet side) surface of the water containing structure, and a ring portion 22*b* of the grommet flush with the inner surface of the opening 312, thus creating both the friction fit and a watertight seal.

The present disclosure is generally related to installation tools 100, 200, housings 10, 300 suitable for use with the installation tools 100, 200, and systems and methods of use thereof. The installation tools 100, 200 may take various forms, structures, and configurations as there are various grommet features for a water containing structure that are significantly distinct for various housings 10, 300. Nonetheless, even though the detailed description is primarily related to installation tools 100, 200 for use with jet housing 300, this does not limit the scope of the present disclosure. Instead, the installation tools 100, 200 of the present disclosure, and the teachings, suggestions, and motivations contained therein, are equally applicable to grommet features 20*a*-20*e* as well as any other other component or sub-system for a water containing structure involving a grommet 22.

More specifically, just like the exemplary and non-limiting slide-hammer 100 is configured to drive the housing 10 into a grommet 22 via a succession of consistent and repeatable strikes or impacts, wherein each successive strike or impact imparts an insertion force, an exemplary installation tool for grommet features 20*a*, 20*b*, 20*c*, 20*d* and/or 20*e* (not specifically depicted in the figures) is also configured to drive the corresponding sub-component and/or sub-system into the grommet 22. In this way, if applicable, any remaining components or sub-systems of the grommet features 20*a*-20*e* may be installed off of the components or sub-systems of the grommet-features 20*a*-20*e* that was/were successfully installed into the grommet 22 via the installation tool and method of the present disclosure. A person of ordinary skill in the art readily understands that this may be necessary for grommet-feature 20*a*, for example.

Furthermore, just like the exemplary and non-limiting housing engagement component 101 of the slide-hammer 100 may be engaged up against the opening perimeter 12 of the housing 10, an exemplary installation tool for grommet-features 20*a*, 20*b*, 20*c*, 20*d* and/or 20*e* (not specifically depicted in the figures) may comprise a specific sub-component or sub-system configured to engage up against a specific region, portion, sub-component and/or sub-system of the grommet-features 20*a*, 20*b*, 20*c*, 20*d* and/or 20*e* (i.e., the engagement portion/region 24). Moreover, just like the exemplary and non-limiting housing engagement component 101 is structured and configured as a one-size-fits-all or one-size-fits-most component for most industry standard housing sizes, the exemplary installation tool for grommet features 20*a*, 20*b*, 20*c*, 20*d* and/or 20*e* may comprise a specific sub-component or sub-system that similarly corresponds to, and complements, the engagement portion/region 24 and any possible variations with different sizes or magnitudes.

In this way, the exemplary installation tools 100, 200 for grommet features 20*a*, 20*b*, 20*c*, 20*d* and/or 20*e*, and the systems and methods of use thereof, may be better suited and more precise than the customary rubber mallet typically used. Moreover, the installation tools 100, 200 for grommet features 20*a*, 20*b*, 20*c*, 20*d* and/or 20*e*, and the systems and methods of use thereof, may reduce or eliminate the possibility of erratic hammer blows that may partially translate an insertion force asymmetrically onto the grommet features 20*a*, 20*b*, 20*c*, 20*d* and/or 20*e*, and that may partially translate the insertion force onto the surrounding portions (e.g., the surrounding molded shell) of the water containing structure. Moreover, the installation tools 100, 200 for grommet features 20*a*, 20*b*, 20*c*, 20*d* and/or 20*e*, and the systems and methods of use thereof, may be structured and configured to maintain position and alignment with the engagement portions/regions 24. Moreover, the installation tools 100, 200 for grommet features 20*a*, 20*b*, 20*c*, 20*d* and/or 20*e*, and the systems and methods of use thereof, may be configured to symmetrically translate and impart any generated insertion force to the engagement portions/regions 24.

A representative system for mounting a component onto a wall of a water containing structure, comprises:

a) the component;

b) a grommet for sealing the component into an opening through the wall of a water containing structure;

c) an installation tool for installing the component into the opening through the wall of a water containing structure, the installation tool being one of a pusher tool for pushing the component into the opening through the wall of a water containing structure and a puller tool for pulling the component into the opening through the wall of a water containing structure, wherein the grommet creates a substantially watertight seal between the component and the opening through the wall of a water containing structure, wherein the installation tool operates on an end of the component that faces into a wet side of a water containing structure, and wherein the puller tool operates on an end of the component that extends into a dry side of a water containing structure.

The installation tool can be a pusher tool having a slide hammer comprising a housing engagement component, a slide component, a support component, an insertion force generating sub-system, and an assembly sub-system. The housing engagement component can comprises a stepped tip configuration for engaging symmetrically along the periphery of the component. The slide component can be an elongate, rigid, cylindrical rod structured and configured as a shaft upon which a hammer component or a sub-system mechanically reciprocates or slides to strike an anvil component or sub-system. The insertion force generating sub-system can be a multi-piece system configured to generate at least a portion of the insertion force to be translated through the slide-hammer. The insertion force generating sub-system can be, at least partially, via the slide component, in a reciprocating configuration relative to the housing engagement component. The assembly sub-system can be a multi-piece attachment set configured to facilitate the detachable yet rigid engagement between all the components and sub-systems of the slide-hammer.

The installation tool can be a pusher tool having a tamp-for-hammer assembly comprising a housing engagement component, a shortened stem, an anvil handle, and an assembly sub-system. The shortened stem can be an elongate, rigid, cylindrical rod structured and configured as a shaft through which an insertion force applied to the anvil handle is translated to the housing engagement component. The anvil handle is configured to receive at least a portion of an insertion force via a hammer strike.

The installation tool can be a puller tool having a hooking portion and a pulling handle. The hooking portion can be configured to hook onto a tab or ear on the component. The hooking portion can comprise at least one hook for engaging the tab or ear. The hooking portion can be attached to and extends from the pulling handle in a generally normal direction whereby a user can grasp the handle portion and manipulate the hooking portion.

The component can comprise a tab or ear for engagement by the installation tool. The tab or ear can be a protrusion from a surface of the component normal to or at least obtuse to an axis of a major cylindrical portion of the component.

A representative method for mounting a component onto a wall of a water containing structure, comprises:

a) placing a grommet for sealing the component into an opening through the wall of a water containing structure either about the component or within the opening;

b) installing the component into the opening through the wall of a water containing structure using an installation tool selected from the group consisting of a pusher tool for pushing the component into the opening through the wall of a water containing structure, a puller tool for pulling the component into the opening through the wall of a water containing structure, and combinations thereof, wherein the grommet creates a substantially watertight seal between the component and the opening through the wall of a water containing structure, wherein if a pusher tool is used, the pusher tool operates on an end of the component that faces into a wet side of a water containing structure, and wherein is a puller tool is used, the puller tool operates on an end of the component that extends into a dry side of a water containing structure.

In the representative method, the installation tool can be a pusher tool selected from the group consisting of a slide hammer comprising a housing engagement component, a slide component, a support component, an insertion force generating sub-system, and an assembly sub-system; and a tamp-for-hammer assembly comprising a housing engagement component, a shortened stem, an anvil handle, and an assembly sub-system. The installation tool can be a puller tool having a hooking portion and a pulling handle. The component can comprise a tab or ear for engagement by the installation tool.

Other representative systems and methods can comprise subsets of the above described system and method, such as, for example, a system or method using only the installation tool a system using only the pulling tool. Preferred systems and methods all include the component for mounting onto the wall of the water containing structure and the grommet for sealing the component into an opening through the wall of the water containing structure.

The various embodiments are provided by way of example and are not intended to limit the scope of the disclosure. The described embodiments comprise different features, not all of which are required in all embodiments of the disclosure. Some embodiments of the present disclosure utilize only some of the features or possible combinations of the features. Variations of embodiments of the present disclosure that are described, and embodiments of the present disclosure comprising different combinations of features as noted in the described embodiments, will occur to persons with ordinary skill in the art. It will be appreciated by persons with ordinary skill in the art that the present disclosure is not limited by what has been particularly shown and described herein above. Rather the scope of the invention is defined by the appended claims.

What is claimed is:

1. A system for mounting a component onto a wall of a water containing structure, comprising:

a) the component;

b) a grommet for sealing the component into an opening through the wall of a water containing structure;

c) an installation tool for installing the component into the opening through the wall of a water containing structure, the installation tool configured as a pusher tool for pushing the component into the opening through the wall of a water containing structure;

d) a puller tool configured as a pulling tool for pulling the component into the opening through the wall of a water containing structure, wherein the grommet creates a substantially watertight seal between the component and the opening through the wall of a water containing structure, wherein the installation tool operates on an end of the component that faces into a wet side of a water containing structure, and wherein the puller tool operates on an end of the component that extends into a dry side of a water containing structure.

2. The system of claim 1, wherein the first installation tool comprises a slide hammer comprising a housing engagement component, a slide component, a support component, an insertion force generating sub-system, and an assembly sub-system.

3. The system of claim 2, wherein the housing engagement component comprises a stepped tip configuration for engaging symmetrically along the periphery of the component.

4. The system of claim 2, wherein the slide component is an elongate, rigid, cylindrical rod structured and configured as a shaft upon which a hammer component or a sub-system mechanically reciprocates or slides to strike an anvil component or sub-system.

5. The system of claim 2, wherein the insertion force generating sub-system is a multi-piece system configured to generate at least a portion of the insertion force to be translated through the slide-hammer.

6. The system of claim 5, wherein the insertion force generating sub-system is, at least partially, via the slide component, in a reciprocating configuration relative to the housing engagement component.

7. The system of claim 2, wherein the assembly sub-system is a multi-piece attachment set configured to facilitate a detachable and rigid engagement between all the components and subsystems of the slide-hammer.

8. The system of claim 1, wherein the installation tool comprises a tamp-for-hammer assembly, the tamp-for-hammer assembly comprising a housing engagement component, a shortened stem, an anvil handle, and an assembly sub-system.

9. The system of claim 8, wherein the shortened stem is an elongate, rigid, cylindrical rod structured and configured as a shaft through which an insertion force applied to the anvil handle is translated to the housing engagement component.

10. The system of claim 8, wherein the anvil handle is configured to receive at least a portion of an insertion force via a hammer strike.

11. The system of claim 1, wherein the puller tool comprises a hooking portion and a pulling handle.

12. The system of claim 11, wherein the hooking portion is configured to hook onto a tab or ear on the component.

13. The system of claim 12, wherein the hooking portion comprises at least one hook for engaging the tab or ear.

14. The system of claim 12, wherein the hooking portion is attached to and extends from the pulling handle in a generally normal direction whereby a user can grasp the handle portion and manipulate the hooking portion.

15. The system of claim 1, wherein the component comprises a tab or ear for engagement by the puller tool.

16. The system of claim 15, wherein the tab or ear is a protrusion from a surface of the component normal to or at least obtuse to an axis of a major cylindrical portion of the component.

17. A system for mounting a component onto a wall of a water containing structure, comprising:

a) the component, the component comprising a tab or ear protruding from an outer surface of the component;

b) a grommet for sealing the component into an opening through the wall of a water containing structure;

c) an installation tool for installing the component into the opening through the wall of a water containing structure, the installation tool configured as a pusher tool for pushing the component into the opening through the wall of a water containing structure, the installation tool comprising a stepped tip configuration for engaging symmetrically along the periphery of the component for pushing the component;

d) a puller tool configured as a pulling tool for pulling the component into the opening through the wall of a water containing structure, the puller tool comprising a hooking portion and pulling handle, the hooking portion comprising at least one hook for engaging the tab or ear of the component and for pulling the component, wherein the grommet creates a substantially watertight seal between the component and the opening through the wall of a water containing structure, wherein the installation tool operates on an end of the component that faces into a wet side of a water containing structure, and wherein the puller tool operates on an end of the component that extends into a dry side of a water containing structure.

18. The system of claim 17, wherein the hooking portion is attached to and extends from the pulling handle in a generally normal direction whereby a user can grasp the handle portion and manipulate the hooking portion.

19. The system of claim 17, wherein the tab or ear is a protrusion from a surface of the component normal to or at least obtuse to an axis of a major cylindrical portion of the component.

* * * * *